US010399140B2

(12) United States Patent
Zhou

(10) Patent No.: US 10,399,140 B2
(45) Date of Patent: Sep. 3, 2019

(54) METHOD FOR ROLLING EXTERNAL PIPE THREADS, ROLLING HEAD AND DEVICE THEREOF

(71) Applicant: SHANGHAI PAN-CHINA FASTENING SYSTEM CO., LTD., Shanghai (CN)

(72) Inventor: Jun Zhou, Shanghai (CN)

(73) Assignee: SHANGHAI PAN-CHINA FASTENING SYSTEM CO., LTD., Shanghai (CN)

( * ) Notice: Subject to any disclaimer, the term of this patent is extended or adjusted under 35 U.S.C. 154(b) by 800 days.

(21) Appl. No.: 14/781,460

(22) PCT Filed: Mar. 31, 2014

(86) PCT No.: PCT/CN2014/074354
§ 371 (c)(1),
(2) Date: Dec. 28, 2015

(87) PCT Pub. No.: WO2014/161447
PCT Pub. Date: Oct. 9, 2014

(65) Prior Publication Data

US 2016/0136721 A1 May 19, 2016

(30) Foreign Application Priority Data

Mar. 31, 2013 (CN) ..... 2013 1 0110406

(51) Int. Cl.
*B21H 3/04* (2006.01)

(52) U.S. Cl.
CPC ..... *B21H 3/04* (2013.01); *B21H 3/044* (2013.01)

(58) Field of Classification Search
CPC . B23G 1/02; B23G 1/22; B23G 1/225; B23G 3/005; B23G 3/08; B23G 3/14;
(Continued)

(56) References Cited

U.S. PATENT DOCUMENTS 1,530,686 A * 3/1925 Muller ..... B23G 1/22 408/28
2,583,094 A * 1/1952 Girz ..... B23G 1/22 470/188

(Continued)

FOREIGN PATENT DOCUMENTS

CN 2555962 6/2003
CN 1480666 3/2004

(Continued)

OTHER PUBLICATIONS

International Search Report for international application No. PCT/CN2014/074354, dated Jun. 25, 2014 (4 pages).

*Primary Examiner* — Edward T Tolan
(74) *Attorney, Agent, or Firm* — Hamre, Schumann, Mueller & Larson, P.C.

(57) ABSTRACT

This invention provides a method for rolling an external pipe thread, a rolling head and device thereof. A rolling wheel carries out a thread rolling, wherein the thread rolling starts from a thread tail of the external pipe thread and moves towards a thread head of the external pipe thread, thereby completing the thread rolling. The rolling head of the invention comprises at least one rolling wheel arranged along a circumference, a corresponding rolling wheel axle and a corresponding rolling wheel seat; the rolling wheel is rotatably fixed to the rolling wheel seat via the rolling wheel axle; and the rolling wheel is provided with a pipe thread forming part having a thread length less than an effective thread length of the external pipe thread to be rolled. The rolling head of the invention also comprises a radial regulating device that can realize dynamic rolling and real-time whole-process regulation of radial position of the rolling wheel for the purpose of forming the taper as required by rolling process. The invention also provides rolling device including aforesaid rolling head. Solutions as provided by
(Continued)

this invention are expected to guard against deformation to the pipe end during rolling, significantly save materials for hollowed cylindrical blank, and improve the rate of finished products.

6 Claims, 19 Drawing Sheets

(58) Field of Classification Search
CPC ... B23G 7/00; B23G 7/02; B21H 3/04; B21H 3/042; B21H 3/044; B21H 3/046; B21H 3/02
See application file for complete search history.

(56) References Cited

U.S. PATENT DOCUMENTS

| | | | | | |
|---|---|---|---|---|---|
| 2,717,401 | A * | 9/1955 | Menzies | B23G 7/00 | 33/21.1 |
| 2,720,801 | A * | 10/1955 | Erdelyi | B21H 3/046 | 408/151 |
| 2,768,393 | A * | 10/1956 | Sayce | B23G 1/02 | 408/1 R |
| 3,058,196 | A | 10/1962 | Bour | | |
| 3,365,924 | A * | 1/1968 | Cummings | B21H 3/046 | 72/100 |
| 3,452,567 | A | 7/1969 | Marcovitch | | |
| 3,855,832 | A | 12/1974 | Novak | | |
| 4,617,816 | A | 10/1986 | Brinkman | | |
| 4,771,625 | A * | 9/1988 | Watanabe | B21H 3/042 | 72/121 |
| 4,785,649 | A | 11/1988 | Watanabe et al. | | |
| 5,699,691 | A | 12/1997 | Maruyama | | |
| 5,870,918 | A | 2/1999 | Schunk et al. | | |
| 2006/0162411 | A1 | 7/2006 | Kubota et al. | | |
| 2011/0108149 | A1 * | 5/2011 | Xiao | B21H 3/02 | 138/109 |
| 2012/0011912 | A1 | 1/2012 | Flegel et al. | | |

FOREIGN PATENT DOCUMENTS

| | | |
|---|---|---|
| CN | 1555938 | 12/2004 |
| CN | 1251821 | 4/2006 |
| CN | 101209523 | 7/2008 |
| CN | 100542735 | 9/2009 |
| CN | 102198590 | 9/2011 |
| CN | 102433789 | 5/2012 |
| CN | 202316603 | 7/2012 |
| CN | 103264128 | 8/2013 |
| CN | 103286245 | 9/2013 |
| EP | 0282889 | 9/1988 |
| GB | 1150525 | 4/1969 |
| JP | H01273637 | 11/1989 |
| JP | H09327742 | 12/1997 |
| JP | H1034270 | 2/1998 |
| JP | H10244340 | 9/1998 |
| JP | 2000061571 | 2/2000 |
| JP | 2002126845 | 5/2002 |
| JP | 2003126937 | 5/2003 |
| RU | 2277990 | 6/2006 |
| SU | 703197 | 12/1979 |
| SU | 1344479 | 10/1987 |

* cited by examiner

METHOD FOR ROLLING EXTERNAL PIPE THREADS, ROLLING HEAD AND DEVICE THEREOF

This application claims the benefit of and priority of prior application CN201310110406.0, filed on Mar. 31, 2013.

FIELD

The invention generally relates to pipe products and pipe processing machineries, and in particular to a method for rolling external pipe thread, a rolling head and a device thereof.

BACKGROUND

External pipe thread through rolling has attracted attention owing to having higher mechanical connection strength and excellent sealing performance compared with external pipe thread through cutting. The corresponding manufacturing processes have also been disclosed in Chinese patent CN200310111695.2 and No. CN200710106912.7. However, according to these two processes for rolling an external pipe thread disclosed in the above two patents, a conical surface is achieved through axial punching or radial extrusion prior to rolling an external pipe thread. As compared with one-off shaping process for cutting external pipe thread, the two processes require that a hollowed cylindrical blank is axial punched or radial extruded with a conical mold mechanically or hydraulically, i.e. a conical surface is processed firstly, and then a external pipe thread is processed on the conical surface which have been processed.

Obviously, these two processes for rolling external pipe thread have the following three problems:

1. As compared with existing external pipe thread process by means of threading and cutting, the process for rolling an external pipe thread needs an additional conical surface processing procedure, it is time-consuming and inconvenient for on-the-spot external pipe thread processing for the pipe network, thus unacceptable.

2. Due to extremely high pressure produced by instantaneous axial punching or radial extrusion, piping material at the junction between original outer diameter of the steel pipe and the conical surface, especially weld on the welded pipe, is vulnerable to hidden and apparent damages to the extent of incurring safety hazards to external pipe thread products when shaping conical surface.

3. Outer diameter of existing rolled steel pipe blank defined by a cutting process is excessive for rolling. Although taper of conical surface formed through punching is 1:16, taper of conical surface on inner diameter of rolled products is over the standard taper of 1:16, or length of the conical surface greatly exceeds the permissible standard value. As a result, the actual maximum reduction in inner hole on the rolled external pipe thread product exceeds the permissible maximum reduction in inner diameter as incurred by accumulated maximum discrepancy to wall thickness of steel pipe and outer diameter of the steel pipe. This may affect fluid conveying stability to some extent.

On the other hand, failure to proceed with conical surface processing to the outer diameter of existing standard steel pipe may result in either excessive dimension of external pipe thread rolled or deformation or cracking to the pipe. Therefore, punching or extrusion is an essential process for external pipe thread rolling. This is mainly caused by defects of processes designs in the above two patents and outer diameter of steel pipe used as rolling for an external pipe thread in the technology of cutting processes for rolled steel pipe.

In view of the fact that excessive outer diameter of milled steel pipe is inappropriate for direct rolling, it is applicable to proceed with rolling to reduce outer diameter of the steel pipe to the designated dimension, namely standard intermediate diameter for external pipe thread based on rolling techniques prior to rolling of conical external pipe thread. However, such method for reducing of outer diameter of steel pipe to be rolled may result in such problems as difficulty in controlling ovality, damage to the plated coating on the surface of steel pipe and reduced inner hole on the steel pipe after rolling. The method to solve such problems is to directly produce rolled steel pipe of special outer diameter lower than that of the standard steel pipe according to technical requirements for rolling. However, as there are no national or international standards on outer diameter and wall thickness of rolled steel pipes, it will take a relatively long time for market promotion and acceptance. This may inevitably affect the promotion and application of external pipe thread rolling processes.

In view of aforesaid description and analysis, it can be seen that, for current steel pipes having a standard outer diameter, omission of axial punching or radial extrusion and simplification of technical procedures for the purpose of producing rolled external pipe thread according to national and international standard and people's operation habit are critical to promote a perfect external pipe thread rolling technique.

SUMMARY

The objective of the invention is to provide a preparation process for forming conical surface that requires no mechanical or hydraulic axial punching or radial extrusion of hollowed cylindrical blanks with conical molding machineries by taking existing standard outer diameter for piping materials as that for hollowed cylindrical blanks for rolling external pipe thread. It provides a method, a rolling head and a device thereof for formation of sealed conical external pipe thread through direct rolling on the hollowed cylindrical blanks with standard outer diameter for piping materials based on one-time throughout rolling process, which is expected to provide a simple, applicable and comprehensive conical external pipe thread rolling process in accommodation with people's operation habit.

On one hand, the invention provides a method for rolling an external pipe thread, characterized in that carrying out a thread rolling with a rolling wheel, wherein the thread rolling starts from a thread tail of the external pipe thread and moves towards a thread head of the external pipe thread, thereby completing the thread rolling.

Presently, there are two thread rolling processes, namely radial rolling process and axial rolling process. As proved in practice, radial rolling technique with a history of more than 70 years is unlikely to implement external pipe thread rolling without the help of mandrel; whereas existing external pipe thread rolling technique still follows the external pipe thread cutting mode, which belongs to axial rolling starting from the initial end for engagement of internal and external threads, namely front end of the thread for rolling of the whole external pipe thread. In addition to technical prejudice, existing axial rolling technique is only available for thread rolling from the front end of the thread; otherwise, thread length of the pipe thread products may far exceed standard pipe thread length. Technical difficulties in radial and axial rolling and adherence to cutting techniques will inevitably generate the technique in which external pipe thread is rolled from the front end of the thread. As the orifice end serves as the end of minimum diameter for the external pipe thread, it may produce the most serious radial deformation as compared with other pipe thread sections. The orifice will bear excessive radial stress at the initial rolling stage (engagement of several rolling wheels); meanwhile, rolling pressure on the piping materials is to be further enhanced during further shaping of external pipe thread and cold hardening of materials; this may incur cracking to the weld or deformation commenced from the orifice end of welded or thin-wall pipes; consequently, this may further result in requirements on diameter reduction or punching or extrusion of taper for piping materials in the current external pipe thread rolling techniques. Moreover, it also has very strict requirements for such technical indicators as composition of piping materials, wall thickness, wall thickness evenness and weld quality. Even so, acceptance rate of external pipe thread products rolled with existing rolling technique is unlikely to exceed 80% due to undemanding standards for piping materials during practice operation. Unreliable external pipe thread rolling technique may make it difficult for promotion of the existing external pipe thread rolling techniques, especially existing on-the-spot external pipe thread rolling techniques. The invention has overcome existing technical difficulties in radial rolling and prejudice on axial rolling of external pipe thread, and has creatively introduced a method for rolling external pipe thread by carrying out a thread rolling process from the rear end of the external pipe thread. On one hand, it makes use of non-orifice part (inside) of the piping materials that is unlikely to yield to deformation under extrusion as compared with the orifice; on the other hand, with regard to external pipe thread, especially conical external pipe thread, it makes use of technical standard on incomplete thread on the rear thread part to effectively reduce rolling pressure during engagement between initial rolling wheel and hollowed cylindrical blanks, and significantly improve the applicability of the piping materials; it is applicable to use seamed, seamless, thick-wall and thin-wall piping materials as well as other metallic piping materials, such as relatively soft cooper pipes of varied wall thickness or aluminum pipes; it is also applicable to maintain the product acceptance rate over 99.9%, and significantly enhance the technical applicability of pipe thread rolling techniques through calculation of yield strength of various piping materials and the force produced during rolling of external pipe thread.

To further reduce the rolling pressure on the hollowed cylindrical blanks, a further preferred feature of aforesaid external pipe thread rolling method according to the invention is that the rolling wheel is provided with a pipe thread forming part which has a thread length less than an effective thread length of the external pipe thread to be rolled. In a further preferred embodiment, the thread length of the pipe thread forming part is equivalent to a length of one, two, three, four or five circles of the external pipe thread. The preferred one is equivalent to a length of one, two, three and four circles of the external pipe thread.

Thread length of the pipe thread forming part of the rolling wheel on existing external pipe thread rolling equipment according to prior art is over or equal to the effective thread length of the external pipe thread. In this way, contact area between the rolling wheel and cylindrical blank of piping material is to be continuously enhanced accompanied by rolling; whereas, rolling pressure on the cylindrical blank of piping materials is to be continuously increased accompanied by cold hardening of materials, which is apt to incur deformation and cracking to the piping materials, especially the orifice. Thread length of the external pipe thread forming part of the invention is below the effective thread length of the rolling wheel used for rolling external pipe thread, which can effectively reduce the contact area. It can also reduce the radial force as imposed by the rolling pressure on the cylindrical blank of the piping materials while ensuring adequate thread forming; this can relax requirements for piping materials, weld and wall thickness, and save expenses for rolling wheel material and manufacturing cost. Meanwhile, it can further optimize external pipe thread rolling techniques, and maintain the product acceptance rate over 99.9%.

The above rolling method as provided by the invention is applicable to rolling of cylindrical and conical external pipe thread.

The invention has creatively introduced a concept on real-time taper of external pipe thread and has added a dynamic real-time regulating device for whole-process adjustment of radial position during whole process of rolling when using aforesaid rolling method to roll conical external pipe thread. The real-time taper and radial position regulating device for external pipe thread is available for dynamic real-time regulation of radial movement position of the rolling wheel seat during the whole process of rolling. The purpose is to achieve real-time taper rolling, and overcome prejudice on conical surface formation through axial punching or radial extrusion in case of rolling external pipe thread. The invention makes use of axial rolling force to facilitate axial rolling and movement of the rolling wheel from the rear end of the thread to the front end or axial movement of hollowed cylindrical blanks from the rear end of the thread to the front end in corresponding to the rolling wheel; meanwhile, the rolling wheel controlled by the radial position regulation device is used for synchronous dynamic radial feeding as per real-time taper to change the radial feeding of the rolling wheel based on variation to the axial rolling position; this is expected to realize shaping of conical external pipe thread without punching or extrusion of conical surface, and make the pipe thread rolling technique more convenient and applicable. Existing pipe thread rolling technique is also known as axial rolling technique. In other words, once adjustment to the radial position of the rolling wheel inside the rolling equipment is completed, hollowed cylindrical blanks are to be fed into the rolling position; whereas radial position of the rolling wheel is to be fixed until the rolling is completed. After that, rolling wheel is to be ejected accompanied by withdrawal of work pieces. Despite of the fact that rolling wheel is available for radial feeding and withdrawal regulation, its feeding movement has nothing to do with pipe thread shaping, especially formation of conical surface; its pieces, technical approaches and final technical effect are quite different from those in the present invention.

In a preferred embodiment, the rolling wheel regulates its radial position in real-time during a whole process of dynamic rolling through a radial position regulating device so as to form a taper as required by a rolling process.

In a preferred embodiment, an axial rolling force as produced by the rolling wheel during the thread rolling is used to shift the rolling wheel from the thread tail towards the thread head relative to a hollowed cylindrical blank, while the radial position regulating device is used to control a radial feeding of the rolling wheel according to variation of axial position of the rolling wheel so that the conical external pipe thread is formed by rolling directly.

In a preferred embodiment, axial rolling movement of the rolling wheel in correspondence to the hollowed cylindrical blank is achieved through axial movement of the rolling head axle; whereas the hollowed cylindrical blank is static.

In other words, the hollowed cylindrical blank is in axial movement; whereas the rolling head is axially static or both of them are in relative movement axially.

In a preferred embodiment, a ratio between radial feeding velocity of the rolling wheel and axial shifting velocity of the rolling wheel relative to the hollowed cylindrical blank is equivalent to ½ of a real-time taper of the external pipe thread. The ratio between radial feeding velocity of the rolling wheel and axial shifting velocity of the rolling wheel relative to the hollowed cylindrical blank is equivalent to 1/32 when rolling BSPT and NPT standard external conical pipe thread.

On the other hand, the invention also provides an external pipe thread rolling head, characterized in that the external pipe thread rolling head comprises at least one rolling wheel arranged along a circumference, a corresponding rolling wheel axle and a corresponding rolling wheel seat; the rolling wheel is rotatably fixed to the rolling wheel seat via the rolling wheel axle; and the rolling wheel is provided with a pipe thread forming part having a thread length less than an effective thread length of the external pipe thread to be rolled.

The number of the rolling wheel is 2 over 2, and preferably is 4 or 5.

The rolling head of the invention is available for convenient rolling of conical external pipe thread. It is also applicable to install a radial position regulating device on the rolling wheel seat to regulate radial position of said rolling wheel during a whole process of dynamic rolling, so as to form a taper as required by rolling techniques. By using rolling axial force as produced by the rolling wheel during rolling of conical external pipe thread, one can achieve axial rolling and movement of the rolling wheel from the rear end of the thread to the front end in corresponding to the hollowed cylindrical blanks. Meanwhile, by using the radial position regulating device to control radial feeding of the rolling wheel for change of radial feeding of the rolling wheel based on variation to the axial rolling position, one can achieve formation of conical external pipe thread through direct rolling.

In a preferred embodiment, axial rolling movement of the rolling wheel in correspondence to the hollowed cylindrical blank is achieved through axial movement of the rolling head axle; whereas the hollowed cylindrical blank is static; in other words, the hollowed cylindrical blank is in axial movement; whereas the rolling head is axially static or both of them are in relatively axial movement.

In a preferred embodiment, the radial position regulating device is generated from a driving source that makes relative rotation of the rolling head and the hollowed cylindrical blank or through any other independent driving sources.

In a preferred embodiment, the radial position and regulating device is selected from the group consisting of manual regulation, regulation by means of mechanical transmission, hydraulic proportion regulation, pneumatic proportion regulation, motor driving gear and rack regulation, ball screw regulation and radial position feeding in company with the axial movement of the rolling head, and the combination thereof.

In a preferred embodiment, the external pipe thread rolling head further comprises an external circular shell plate, a rotating disc, a rolling wheel seat and a rolling wheel; the external circular shell plate is in gap junction with a slide on thread rolling equipment; the rotating disc is coaxially installed on an inner circular axle of the external circular shell plate on one side through axle-borehole fit, and a spiral groove is provided on the side of the rotating disc and opposite to the external circular shell plate; the external circular shell plate is provided with at least one radial rolling wheel seat chute; the rolling wheel seat is moveable radially inside the rolling wheel seat chute on the external circular shell plate via a mutual interaction of multiple convex spiral grooves at bottom of the rolling wheel seat and the spiral groove on the rotating disc; the rolling wheel is installed on the rolling wheel seat; and during rotation of the rotating disc, the rolling wheel drives the rolling wheel seat to radially move along the corresponding chute on the external circular shell plate via the convex spiral groove matching with the spiral groove.

In a preferred embodiment, the external pipe thread rolling head further comprises a gear control level; the other side of the rotating disc is provided with a bevel gear with a central axis in approximate superposition with that of the rolling head; one end of the gear control level is provided with another bevel gear engaged with the bevel gear on the rotating disc and having a central axis arranged along a longitudinal axis of the gear control lever; the longitudinal axis of the gear control level forms a certain angle with the central axis of the rotating disc; and the rotating gear control lever makes the rotating disc rotate around its axis.

In a preferred embodiment, the external pipe thread rolling head further comprises a driving motor which drives the gear control lever for rotation via worm and gear, rack and pinion, ball screw, belt pulley, cam or crank link.

In a preferred embodiment, the external pipe thread rolling head further comprises a powered rotating handle, a lead screw, an upper lever, an intermediate lever, a lower lever and a pair of guide pins; the pair of guide pins have upper and lower ends which are fixed on both sides of the upper lever and the lower lever to form a fixed framework; the pair of guide pins pass through holes on both sides of the intermediate lever and the intermediate lever can slid up and down along the guide pins; the upper lever is provided with a vertical threaded hole therein; the lead screw is available for engagement with the threaded hole and has a upper end fixed to the powered rotating handle and a lower end pressed against the intermediate lever so that the powered rotating handle drives the lead screw for rotation and the intermediate lever can slid up and down along both the guide pins on both sides; and the intermediate lever and the lower lever are provided with a rolling wheel seat and a corresponding rolling wheels, respectively.

In a preferred embodiment, the external pipe thread rolling head further comprises a cylinder, a spring and an adjusting bolt; the cylinder has a upper end fixed to the lower lever and a lower end in flexible fitting with the axle hole on the slid of the thread rolling equipment, so that the fixed framework and the slide on the rolling equipment are floating connection via the spring as covered on the cylinder with both ends being pressed against the lower lever and the slide of the rolling equipment; the adjusting bolt is in downward extension from the lower lever and is separated from the slide of the rolling equipment by a certain distance, and the swing amplitude of the fixed framework is controlled by adjusting length of the adjusting bolt so as to adjust the distance between the adjusting bolt and the slide of the rolling equipment, thereby ensuring that the hollowed cylindrical blank is concentric with the rolling head; and the lead screw drives the intermediate lever for moving on the guide pins upwards and downward by rotating the powered rotating handle, thereby realizing a dynamic adjustment to the radial position of the rolling wheel when the rolling head moves axially.

In a preferred embodiment, the pipe thread forming part of the rolling wheel contains at least one circle of thread; and the thread has a profile corresponded to that of the external thread of the cylindrical or conical pipe to be processed.

In a preferred embodiment, when the rolling wheels are used to roll a 55° BSPT conical external pipe thread, for a pipe with a diameter of DN4, DN6, DN8, DN15, DN20, DN25, DN32 or DN40, the thread length of the pipe thread forming part of the rolling head is less than 6 circles, preferably 1 or 2 circles; for a pipe with a diameter of DN50, DN65, DN80 or DN90, the thread length of the pipe thread forming part is less than 9 circles, preferably 1, 2 or 3 circles; for a pipe with a diameter of DN100, DN125, DN150 and above, the thread length of the pipe thread forming part is less than 14 circles, preferably 1, 2, 3 or 4 circles; when the rolling wheel is used to roll a 60° NPT conical external pipe thread, for a pipe with a diameter of DN4, DN6, DN8, DN15, DN20, DN25, DN32 or DN40, the thread length of the pipe thread forming part is less than 5 circles, preferably 1 or 2 circles; for a pipe with a diameter of DN50, DN65, DN80 or DN90, the thread length of the pipe thread forming part is less than 8 circles, preferably 1, 2 or 3 circles; for a pipe with a diameter of DN100, DN125, DN150 or above, the thread length of the pipe thread forming part is less than 13 circles, preferably 1, 2, 3 or 4 circles; and when the rolling wheel is used to roll an API conical external pipe thread, the thread length of the pipe thread forming part is less than 90% of the corresponding effective thread length, preferably 1, 2, 3, 4 or 5 circles.

In a preferred embodiment, the rolling wheel is a spiral rolling wheel or a circular rolling wheel or a reasonable combination thereof.

In a preferred embodiment, the rolling wheel further comprises a pre-forming part on head end of the pipe thread forming part and the pre-forming part has a profile selected from the group consisting of a cylindrical surface, a conical surface, a cylindrical thread, an incomplete conical thread and combination thereof.

In a preferred embodiment, the rolling wheel further comprises a guide part on head end of the pipe thread forming part and the guide part has a profile selected from the group consisting of a conical surface, a cambered surface, a gradually curved surface and combination thereof.

In a preferred embodiment, the rolling wheel further comprises a guide part on head end of the pre-forming part and the guide part has a profile selected from the group consisting of a conical surface, a cambered surface, a gradually curved surface and combination thereof.

In a preferred embodiment, the guide part, the pre-forming part and the pipe thread forming part of the rolling wheel form an integral or combined structure. It is applicable to make use the rolling wheel of the invention for such preliminary rolling treatments as correction and diameter reduction of piping materials so as to effectively relax requirements as required by pipe thread rolling for piping materials, and significantly increase the acceptance rate of pipe thread products.

In a preferred embodiment, the rolling wheel comprises the pipe thread forming part; an axial movement space is present in a direction along the rolling wheel axle of the rolling wheel relative to the rolling wheel seat while a radial movement space is present in a radial direction along the rolling wheel axle of the rolling wheel relative to the rolling wheel seat.

It must be pointed out that rolling wheel and rolling wheel axle of the invention are available for integration and separation.

In a preferred embodiment, the axial movement space is preferably equivalent to 0.1 pitch to 1 pitch of a corresponding thread of the pipe thread forming part, more preferably 0.5 pitch to 1 pitch, most preferably 0.5 pitch or 1 pitch; and the radial movement space is preferably not more than 1 pitch of the corresponding thread of the pipe thread forming part, more preferably not more than 0.5 pitch of the corresponding thread of the pipe thread forming part.

In a preferred embodiment, the axial movement space and the radial movement space are achieved through a structure selected from the group consisting of:

a) a floating connection between the rolling wheel axle and the rolling wheel seat;

b) a floating connection between the rolling wheel and the rolling wheel axle; and c) a combination of a) and b);

wherein the floating connection is selected from the group consisting of an axle hole floating connection and a bearing floating connection.

In one embodiment, the axle hole floating connection comprises:

a contact connection between a surface of the rolling axle hole and a surface of the rolling wheel axle, wherein either or both surfaces are an arc surface; or a contact connection between a surface of the rolling wheel axle and a surface of the rolling wheel seat at the connection position of the axle holes, wherein either or both surfaces are an arc surface.

In one embodiment, the bearing floating connection is achieved by a needle roller bearing, an end bearing or a combination thereof.

The invention also provides a method for rolling external pipe thread with any of above rolling head, wherein the rolling wheel carries out a thread rolling which starts from a thread tail of the external pipe thread and moves towards a thread head of the external pipe thread, thereby completing the thread rolling.

The invention also provides an external pipe thread rolling equipment using any of the above rolling head. The external pipe thread rolling equipment may further comprise: a base, a power motor, a clamping device, a motor switch, and a transmission device connecting the powered motor to the clamping device for hollowed cylindrical work pieces or to the rolling head; wherein the power motor, the motor switch and the clamping device for clamping the hollowed cylindrical blanks to be processed are provided at top portion of the base; a relative rolling movement of the hollowed cylindrical blank as clamped by the rolling wheel and the clamping device is achieved through the transmission device powered by the power motor controlled by the motor switch.

In another embodiment, the external pipe thread rolling equipment further comprises: a hollowed main shaft, two axial guide columns and a sliding seat; wherein the power motor, the transmission device, and the motor switch are provided at one side of top portion of the base; the hollow main shaft is provided at top portion of the power motor; and the transmission device connects a main shaft of the power motor to the hollow main shaft;

the clamping device is provided at the top portion of the base for clamping and rotating the hollowed cylindrical pipe blank to be processed, wherein the clamping device and the hollow main shaft are integrally and coaxially connected;

the two axial guide columns are provided at another side of the top portion of the base, and are provided one after the other and in parallel with a centerline axis of the hollow main shaft;

the sliding seat is provided at the two axial guide columns and can horizontally slide along the axial guide columns;

the rolling head is floatingly provided at the sliding seat, and is coaxial with the hollow main shaft.

The above rolling equipment of the invention may further comprise a chamfering device and/or a rolled trimming device and/or a photoelectric sensing device; wherein the chamfering device is floatingly provided at one side of the sliding seat opposite to the power motor and is coaxial with the hollow main shaft;

the rolling trimming device is provided at one side of the sliding seat opposite to the power motor, and is coaxial with the hollow main shaft;

the photoelectric sensing device is provided in the rolling head to control rolling time as well as rolling sequence forward or backward.

A method for direct rolling a conical external pipe thread on a steel pipe having a standard outer diameter is provided, in which a thread rolling is carried out with a rolling device comprising at least two or more non-full-length rolling wheels distributed on a circumference, wherein the thread rolling starts from an incomplete thread tail of the external pipe thread through an axial force produced during the thread rolling which makes the rolling device axially move from the thread tail towards a thread head, and through radial synchronous feeding of the rolling wheel as controlled by a transmission mechanism in the rolling device, a conical external pipe thread product is directly rolled and shaped at one go.

According to the above method for direct rolling a conical external pipe thread on a steel pipe having a standard outer diameter, preferably, the axial movement of the rolling device refers to gradually axial rolling movement from the incomplete thread tail of the external pipe thread towards a complete thread head of the external pipe thread under the axial force as produced by discrepancy between a thread spiral angle of the rolling wheel and a thread spiral angle of the hollowed cylindrical blank.

The invention further provides a rolling device for direct rolling a conical external pipe thread on a steel pipe having a standard outer diameter comprising at least two or more non-full-length rolling wheels distributed on a circumference, wherein the rolling starts from an incomplete thread tail of the external pipe thread through an axial force produced during the thread rolling which makes the rolling device axially move from the thread tail towards a thread head, and through radial synchronous feeding of the rolling wheel as controlled by a transmission mechanism in the rolling device, a conical external pipe thread product is directly rolled and shaped at one go.

In a preferred embodiment, the device comprises two or more rolling wheels, wherein the rolling wheels are available for manual, mechanical or hydraulic synchronous feeding or synchronous feeding by a worm and worm gear mechanism driven by a motor during axial movement and rolling of the whole rolling device; radial feeding velocity and the proportion of rolling wheels inside the rolling device are set according to the axial movement velocity and proportion of the rolling device in reference to technical requirements for rolling conical external pipe thread.

In a preferred embodiment, an inner hole of the rolling wheel matches with a drum pin installed on a slide available for radial sliding; or a circular inner hole of the rolling wheel matches with a standard pin installed on the slide available for radial sliding; and there is a certain space for axially and radially flexible movement of the rolling wheel between the inner hole of the rolling wheel and the pin.

In a preferred embodiment, the non-full-length wheels are provided with one or more circles of a corresponding standard cylindrical external pipe thread or a conical external pipe thread.

In a preferred embodiment, when the rolling wheels are used to roll a 55° BSPT conical external pipe thread, for a pipe with a diameter of DN4, DN6, DN8, DN15, DN20, DN25, DN32 or DN40, the thread length of the rolling wheels is less than 6 circles; for a pipe with a diameter of DN50, DN65, DN80 or DN90, the thread length of the rolling wheels is less than 9 circles; for a pipe with a diameter of DN100, DN125 and DN150, the thread length of rolling wheels is less than 14 circles; when the rolling wheel is used to roll a 60° NPT conical external pipe thread, for a pipe with a diameter of DN4, DN6, DN8, DN10, DN15, DN20, DN25, DN32 and DN40, the thread length of the rolling wheel is less than 6 circles; for a pipe with a diameter of DN50, DN65, DN80, DN90, DN100, DN125 and DN150, the thread length of the rolling wheel is less than 7 circles; when the rolling wheel is used to roll an API conical external pipe thread, the thread length of the rolling wheel is less than 80% of the corresponding effective thread length thereof.

In a preferred embodiment, the rolling wheels for rolling external pipe thread are spiral rolling wheels or circular rolling wheels or combination thereof. In a preferred embodiment, the rolling wheels are non-full-length external pipe thread rolling wheels or rolling wheels consisting of a guide portion and a non-full-length external pipe thread portion.

In a preferred embodiment, the rolling device is installed on one side of the hollowed cylindrical blanks to be processed for rolling a single-head external pipe thread product or is stalled on both sides of the hollowed cylindrical blanks to be processed for rolling a double-head external pipe thread product.

The invention has the following beneficial effects. The conical external pipe thread rolling device according to prior arts aims to proceed with thread rolling from the orifice end (thread end); thread length of thread forming part of the rolling wheel used is over or equal to the effective thread length of the external pipe thread to be processed. Furthermore, radial position of the rolling wheel subjects to no real-time change during processing of conical external pipe thread, which is to be radially adjusted at the early stage of rolling prior to radial fixing for axial rolling. Therefore, it is necessary to proceed with such preliminary shaping procedures as correction, diameter reduction or punching or extrusion of conical surface to the hollowed cylindrical blanks before rolling. They may increase technical difficulties in on-the-spot rolling of pipe thread, production cost and damages to piping materials. Meanwhile, rolling pressure is to be increased accordingly with increase in contact area between the rolling wheel and piping materials and enhancement of cold hardening of materials accompanied by thread shaping during external pipe thread rolling. So it may put forward high requirements for composition of piping materials, weld, wall thickness, evenness and caliber, thereby making it difficult for promotion of external pipe thread rolling techniques. The invention has creatively introduced the technique for rolling from the rear end of the pipe thread from the front end by overcoming technical prejudices. Meanwhile, the invention makes use of the rolling wheel with thread length of thread forming part lower than the effective length of the external pipe thread and other technical approaches such as radial feeding and rolling of conical surface with rolling wheel to proceed with rolling of incomplete external pipe thread from the rear part of non-end external pipe thread of steel pipe for gradual radial feeding, correction and diameter reduction to the tapered piping materials by using features such as rolling pressure as required by incomplete external pipe thread is lower than that as required shaping of complete external pipe thread end. At the same time, it also aims to roll complete external pipe thread until external pipe thread rolling is completed. This can effectively prevent deformation to piping materials and cracking to piping materials as incurred by excessive radial force and abrupt change during rolling. The invention has solved such problems as damages incurred by punching to piping materials at the junction between original outer diameter and conical surface, especially weld on the welded pipe through omission of radial punching or radial extrusion of conical surface as proposed by existing conical external pipe thread rolling techniques. The invention provide a processing method basically similar to operation procedures for pipe threading that has been used for more than 100 years to realize simplified and applicable external pipe thread rolling in accommodation with people's operation habit, and makes it possible for external pipe thread rolling on the pipe network installation site. Meanwhile, in view of the fact that weight per unit length of the external pipe thread products as formed through rolling and original steel pipe before rolling is to be affected by the cold hardening during rolling, the invention manages to reduce wall thickness of steel pipe with non metal removal technique while improving mechanical connection and sealing safety of external pipe thread as compared with conventional external pipe thread cutting with metal removal technique; it is expected to save 15%-35% steel pipe materials by providing an economical method for energy saving and emission reduction. Moreover, the method for rolling conical external pipe thread, the rolling head and the equipment according to the invention will promote updating of conventional external pipe thread rolling equipments and products and revolutionary improvement of manufacturing of piping machineries, which have high social and economic significance to the piping machinery industry worldwide.

The aforesaid purposes, technical solutions and beneficial effects of the invention are detailed described in preferred embodiments in conjunction with the accompanying drawings.

DETAILED DESCRIPTION

Figure 1:
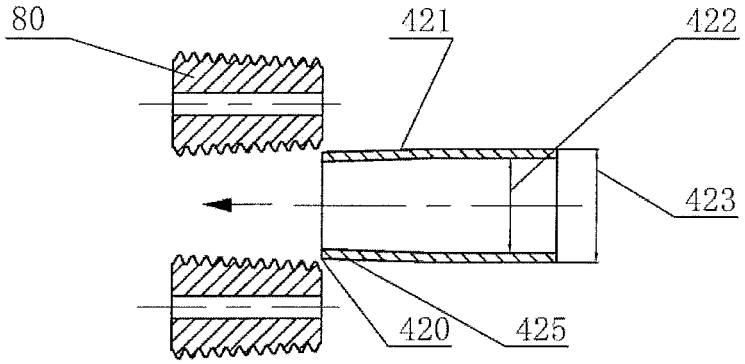
FIG. 1 is a schematic diagram of process for manufacturing a conical external pipe thread according to existing process for rolling external pipe thread.

The following is the detailed description of the invention in combination of preferred embodiments. It should be noted that despite of the fact that all terms used are selected from those known to the public according to description thereafter, some terms are selected by the applicant at its discretion, of which implications are to be interpreted according to the principle as revealed by the invention. Orientation terms such as "upper", "lower", "left" and "right" as used herein is only for description other than limitation on orientation of various devices and parts used.

The rolling head according to the invention is a device used to process external pipe thread through rolling on the hollowed cylindrical blanks, of which main parts include one or more rolling wheels used to roll external pipe thread and the rolling wheel axle and rolling wheel seat used to support or fix the rolling wheel. The rolling wheel engages with the rolling wheel seat via the rolling wheel axle. It should be noted that the rolling wheel and the rolling wheel axle according to the invention are available for separation or integration.

The external pipe thread according to the invention refers to a pipe thread used for engaging with an internal pipe thread in the pipe thread connection, including a cylindrical external pipe thread and a conical external pipe thread. Definitions of thread terms are basically in reference to GB/T 14791. Among them, the external pipe thread includes complete thread, incomplete thread and thread tail. The complete thread refers to a thread having a crest and a root with a complete profile. The incomplete thread refers to a thread having a complete root and an incomplete crest. It should be particularly noted that besides referring to a thread with an incomplete root transition towards to a smooth surface, the thread tail according to the invention also comprises one or more circles of thread with complete root adjacent to the thread with incomplete root. An effective external pipe thread of the external pipe thread according to the invention comprises complete and incomplete external pipe threads, and effective thread length of the external pipe thread can be interpreted as the axial length of the effective thread. The thread head according to the invention refers to the part initially engaging with an internal thread. However, the thread head is not always at the orifice of a pipe in specific embodiments. For instance, if a conical external pipe thread is processed in the reducing zone of a pipe, the corresponding thread head should refer to a side where a pitch diameter of thread is the minimum.

On external surface of the rolling wheel according to the invention is provided with a pipe thread forming part. The pipe thread forming part refers to a thread corresponding to a complete thread to be rolled, which may include a cylindrical external pipe thread or a conical external pipe thread. The cylindrical external pipe thread and the conical external pipe thread comprise BSPT, NPT, API, metric standard pipe outer thread and conical outer pipe thread. Thread length of the pipe thread forming part can be interpreted as an axial length of the thread. According to an existing process for rolling external pipe thread, a thread length of pipe thread forming part of the rolling wheel is over or equal to a length of a complete external pipe thread. However, in the invention, a rolling wheel, with a thread length of a pipe thread forming part less than a length of a corresponding complete external pipe thread, is creatively introduced, thereby significantly reducing the rolling pressure pressed on a pipe during rolling as well as the cost of materials of the rolling wheel and cost of manufacturing. The rolling wheel with a thread length of an external pipe thread forming part less than an effective rolling length of a corresponding external pipe thread is also called a non-full-length rolling wheel.

The pipe thread forming part of the rolling wheel according to the invention comprises one circle of thread at least. The one circle of thread refers to a thread with a continuous axial length equivalent to one pitch. Profile of the thread corresponds to that of a cylindrical or conical external pipe thread to be processed. In other words, aforesaid cylindrical or conical external pipe thread can be rolled through a rolling wheel comprising aforesaid pipe thread forming part.

Besides aforesaid pipe thread forming part, the rolling wheel may also be provided with a pre-forming part or a guide part at an initial position for processing a hollowed cylindrical blank. The initial position for processing a hollowed cylindrical blank refers to the position where the rolling wheel firstly contacts with the hollowed cylindrical blank during processing an external pipe thread. The thread head of the pipe thread forming part according to the invention refers to an end adjacent to the initial position for processing a hollowed cylindrical blank. The pre-forming part has a profile selected from the group consisting of a cylindrical surface, a conical surface, a cylindrical thread, an incomplete conical thread and combination thereof. When the pre-forming part is provided with a cylindrical external pipe thread, profile of the cylindrical external pipe thread is identical to that of the external pipe thread forming part. When the pre-forming part is provided with an incomplete conical external pipe thread, a pitch of the incomplete conical external pipe thread is identical to that of the thread of the pipe thread forming part; a root of the incomplete conical thread is identical to that of the pipe thread forming part; and a crest of the incomplete conical thread is smaller than that of the pipe thread forming part. The guide part has a profile selected from the group consisting of a conical surface, an arc surface, a gradually curved surface or combination thereof.

Furthermore, the rolling wheel also may be provided with a guide part, a pre-forming part and a pipe thread forming part in turn from the initial position for processing a hollowed cylindrical blank. The above all parts can be constructed as an integration structure or a combination structure. The combination structure means that all parts are arranged in turn on the same or different rolling wheel axles or even on different rolling heads in the direction for processing a hollowed cylindrical blank.

The rolling wheel seat of the invention is provided with a radial position regulating device for regulating the rolling wheel radially, so that regulate its radial position in real-time during a whole process of dynamic rolling; the whole process of dynamic rolling means that when the rolling wheel carries out an axial feeding, the rolling wheel carries out a radial feeding continuously at the same time until completing the rolling process. A feeding distance can be complemented timely through an axial and radial feeding by the feedback system so as to satisfy the requirements in the process for rolling a taper.

The radial position regulating device can control the rolling wheel to move free radially in a radial direction inside the rolling head; the radial direction is to be interpreted as the direction vertical to a processing axis of the hollowed cylindrical blank. The rolling wheel carries out a thread rolling process from a thread tail of the external pipe thread during a specific rolling process. Due to a discrepancy between a spiral lift angle of the rolling wheel and an input angle of the hollowed cylindrical blank, the rolling wheel is imposed with an axial rolling force when the rolling wheel moves towards to the cylindrical blank during the rolling process, so that the rolling head moves axially from the thread tail towards the thread head relative to the hollowed cylindrical blank; while the radial position regulating device is used to control a radial feeding of the rolling wheel to keep a set ratio between an axial shifting velocity of the rolling head relative to the hollowed cylindrical blank and a radial feeding velocity of the rolling wheel so that the conical external pipe thread is formed by rolling directly. The axial shifting velocity refers to a shifting velocity of the rolling head moving along the processing axis of the hollowed cylindrical blank relative to the hollowed cylindrical blank. The radial feeding velocity refers to a feeding velocity of the rolling wheel in the direction vertical to the processing axis of the hollowed cylindrical blank. The ratio between radial feeding velocity and axial shifting velocity according to the invention is equivalent to ½ of a real-time taper of the external pipe thread. The real-time taper refers to taper of the external pipe thread corresponding to the thread rolling point, which is two folds of a included angle between a tangent of baseline and a axis line of the external pipe thread to be processed at the point. The baseline of the external pipe thread can be interpreted as a joint line of roots of the thread on the same side in the same axial section through an axis of the external pipe thread to be processed; it is a supposed curve. For instance, the real-time taper is equivalent to 0 when rolling a cylindrical pipe thread, and the radial feeding velocity is also equivalent to 0; the real-time taper is equivalent to taper of the thread, i.e., the real-time taper is equivalent to 1/16, when rolling a BSPT and NPT standard conical pipe thread, and the radial feeding velocity of the rolling wheel is equivalent to 1/32 of the axial shifting velocity of the rolling head relative to the hollowed cylindrical blank; the real-time taper can be changed over time when rolling other external pipe threads containing abnormal threads and accordingly the ratio between the radial feeding velocity of the rolling wheel and the axial shafting velocity of the rolling head relative to the hollowed cylindrical blank is to be set as ½ of the real-time taper. The 55° and 60° conical external pipe threads of the invention correspond to conical external pipe threads as specified in national or international standards. The standard conical external pipe threads include BSPT (GB/T 7306.2-2000), NPT (GB/T 12716-2002) and API (GB/T 9253.2-1999) conical external pipe threads. According to the invention, the external pipe thread can be a line pipe thread, a round sleeve thread, a round oil pipe thread or a buttress sleeve thread when rolling an API standard thread. It should be noted that threads rolled using the rolling method, rolling head and rolling device according to the invention are not limited by the thread standards illustrated herein. Other standard or non-standard threads not mentioned herein are also obtained through rolling according to the concept of the invention. Nominal diameter (DN) of the hollowed cylindrical blanks according to the invention is based on "Welded Steel Pipes for Low Pressure Liquid Delivery (GB3091-2008)". However, other piping materials can be used to roll a thread according to the concept of the invention during specific application.

The movement space of the invention means that there is a space for free movement of the rolling wheel. The axial movement space refers to a space for movement of the rolling wheel along an axis of the rolling wheel axle. The axial distance of the axial movement space is interpreted as the maximum distance of a free movement for the rolling wheel along the axis of the rolling wheel axle. The axial movement space is preferably equivalent to 0.1 pitch to 1 pitch of a corresponding thread of the pipe thread forming part, more preferably 0.5 pitch to 1 pitch, and most preferably 0.5 pitch or 1 pitch. The pipe thread forming part of the rolling wheel refers to a thread of the rolling wheel corresponding to the pipe thread to be rolled. The radial movement space refers to a space for movement of the rolling wheel in a direction vertical to the axis for processing the hollowed cylindrical blanks. The radial movement space is to be interpreted as the maximum distance of a free movement for the pipe thread forming part of the rolling wheel respective to the hollowed cylindrical blank in a direction vertical to the processing axis of the hollowed cylindrical blank. The maximum distance is preferably less than 1 pitch of the corresponding thread of the pipe thread forming part of the rolling wheel, more preferably less than 0.5 pitch of the corresponding thread of the pipe thread forming part of the rolling wheel.

FIGS. 1-6 are schematic diagrams for comparison of an existing process for rolling an external pipe thread with the process for rolling an external pipe thread according to the invention, showing the whole process from preparation of a hollowed cylindrical blank to completing the process for rolling a conical external pipe thread as well as discrepancy to their products.

Figure 2:
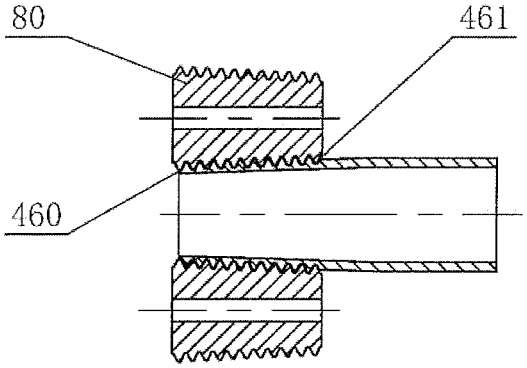
FIG. 2 is a schematic diagram of rolling process shown in FIG. 1.
Figure 3:
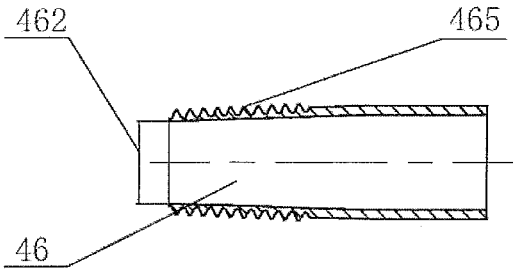
FIG. 3 is a structure sectional view of an external pipe thread product formed through an existing rolling process.

FIGS. 1-3 show schematic diagrams of an existing rolling process using an effective thread length of an external pipe thread rolling wheel with axial movement other than radial feeding and its products.

FIG. 1 shows a conical external pipe thread rolling wheel 80 with an effective thread length of the prior arts. A length of a pipe thread forming part of the rolling wheel is equivalent to corresponding effective thread length; whereas 425 refers to taper of a cylindrical blank.

Firstly, a hollowed cylindrical blank is punched to form a conical surface 425 prior to pipe thread rolling. And then the conical surface is processed through rolling axially from the orifice 420 (i.e., a head 460 of a external pipe thread to be processed) to piping material 421 (i.e., a tail 461 of the external pipe thread to be processed). FIG. 2 clearly shows the process that a contact area between the hollowed cylindrical blank and the rolling wheel 80 continuously increases during the process of rolling until the rolling wheel 80 is in contact with the conical surface 425 through rolling. Obviously, the orifice is under the radial force produced by formation of complete thread at the beginning of rolling; meanwhile, radial force imposed on piping material 420 and 421 is to be continuously increased accompanied during axial rolling. Such rolling process has high requirements for composition of piping materials, welding seam, wall thickness and caliber as well as the process for per-forming the conical surface through punching. As it is difficult to control reduction in inner diameter 462 of orifice 46 of the product during punching or extrusion of conical surface as well as rolling, a conical surface 465 usually exceeds the standard for pipe thread products. Meanwhile, for galvanized pipes, rolling (friction) frequency and damages to the galvanized coat on the head of external pipe thread products are bigger than those in other parts.

Figure 4:
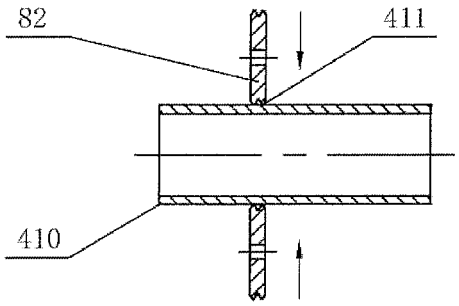
FIG. 4 is a schematic process diagram for rolling a conical external pipe thread with two-circle thread rolling wheel according to the invention.
Figure 5:
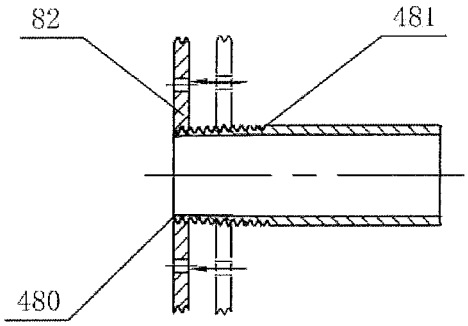
FIG. 5 is a schematic diagram of rolling process shown in FIG. 4.
Figure 6:
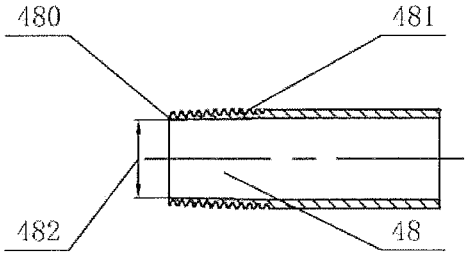
FIG. 6 is a structure sectional view of an external pipe thread product formed through rolling according to the method, rolling head and device of the invention.

FIGS. 4-6 show schematic diagrams of the rolling process on real-time radial feeding as required by rolling process in the whole process of rolling based on axial movement of external pipe thread rolling wheel of the invention and products thereof.

The hollowed cylindrical blank as shown in FIG. 4 has an original outer diameter of piping materials other than the preformed hollowed conical blank as shown in FIG. 1; and the rolling wheel with two circles of thread has threads less than the shortest 55° DN6 pipe external thread with 7 circles of thread by 5 circles of thread. Use the rolling wheel 82 of the invention for axial and radial feeding and rolling from the non-orifice part 411 (namely a tail 481 of the external pipe thread to be processed) to the orifice 410 (namely a head 480 of the external pipe thread to be processed) until it reaches the tail of the external pipe thread product 480 as shown in FIG. 5.

Obviously, a rolling pressure pressed on piping materials during rolling has been significantly reduced as compared with the existing process for rolling a pipe thread as shown in FIGS. 1-3. It ensures roundness of various piping materials of standard wall thickness and complete weld based on complete formation of pipe thread profile. As radial feeding force can be fully controlled during rolling, the inner diameter 482 of product 48 as shown in FIG. 6 is basically constant for pipe thread products of different materials and the same dimension, which fully meet various standards for pipe thread products. Meanwhile, as rolling frequency for threaded sections of piping materials is identical, and the time is basically consistent, evenness of metallographic structure within the threaded sections of piping materials is significantly optimized.

Figure 7:
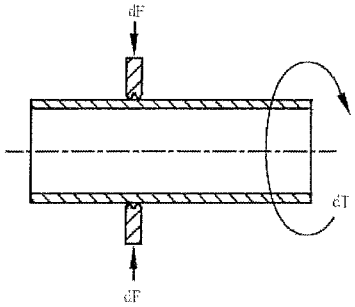
FIG. 7 is a schematic diagram, showing an axial movement of rolling head in corresponding to a hollowed cylindrical blank and a synchronous feeding of a rolling wheel as realized by torque dT produced by relative rotation between the rolling wheel and the hollowed cylindrical blank and by radial regulation force dF of the rolling wheel according to the invention.
Figure 8:
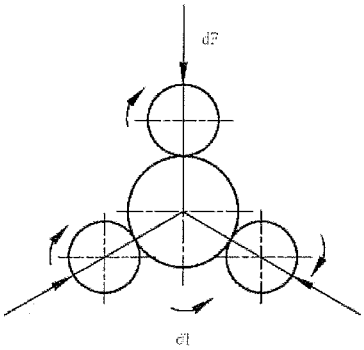
FIG. 8 shows a stress analysis of a work piece during a process for rolling a conical pipe thread with three rolling wheels.
Figure 9:
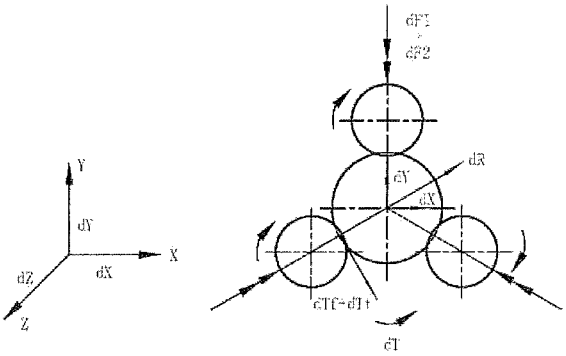
FIG. 9 is a schematic diagram, which further shows a force decomposition of a thread rolling force of FIG. 8.

FIGS. 7-9 show analysis of compression on work pieces during rolling of conical pipe thread with three rolling wheels. A radial force dF and a dynamic torque dT is imposed from outside when rolling. Radial force dF and the tangent (friction) force dTf produced by dF and the tangent (friction) force dTt produced by dT will jointly produce rolling force dX, dY and dZ on the conical pipe thread along Axis X, Y and Z (vertical to the illustrated direction); proportion of force dX, dY and dZ is closely related to factors such as thread profile, spiral angle, pitch, diameter and material of hollowed cylindrical blank, form (installation) of rolling wheel, diameter of rolling wheel and relative revolution of hollowed cylindrical blank. Radial rolling force dR as imposed by the rolling wheel on work pieces serves as the main force (including threading profile force dF1 and conical force dF2) for conversion of hollowed cylindrical blank into conical pipe thread; radial rolling force dR as shown in FIG. 9 is approximately equal to dF, which is parallel or overlapped to the link line between the center of rolling wheel and that of hollowed cylindrical blank. Dynamic torque dT will make hollowed cylindrical blank and rolling wheel produce tangent (friction) force dTt through relative rotation to facilitate rotation of work pieces in together with dTf produced by dF; due to difference between an initial angle of the hollowed cylindrical blank and an actual spiral angle of the rolling wheel, dynamic torque is mainly used to facilitate relatively axial movement (along Axis Z) of hollowed cylindrical blank and rolling head in rotation. Meanwhile, conical shaping force dF2 is to be imposed continuously to facilitate processing of external pipe thread with the method of the invention.

Figure 10:
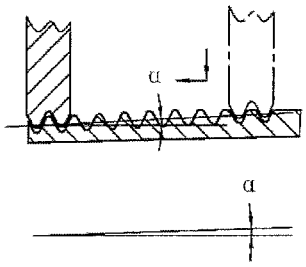
FIG. 10 shows an interrelation between an axial movement velocity and a radial feeding velocity.
Figure 11:
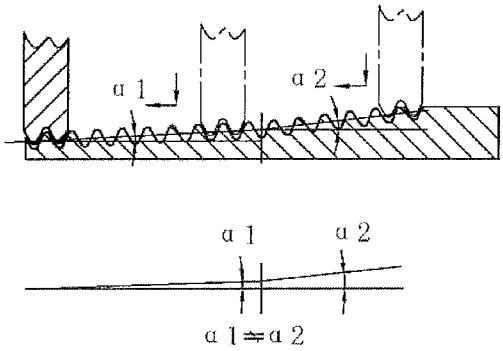
FIG. 11 is a schematic diagram, showing an axial movement velocity and a radial feeding velocity of a non-standard external pipe thread with two different taper.

FIGS. 10-11 aim to provide a further description of interrelation between radial and axial synchronous feeding velocity of standard and non-standard threads.

According to taper of standard pipe thread as indicated in FIG. 10, feeding of rolling wheel is carried out in reference to standard taper during axial rolling. For BSPT, NPT and metric pipe threads, "a" is equivalent to 1/32; for cylindrical pipe thread, "a" is equivalent to 0.

According to taper of non-standard pipe thread as indicated in FIG. 11, a1 is unequal to a2; radial feeding position of rolling wheel is to be in a transition from real-time feeding as per taper a1 to that as per taper a2 during axial rolling to realize controlling of radial feeding through rolling as per real-time taper.

Figure 12:
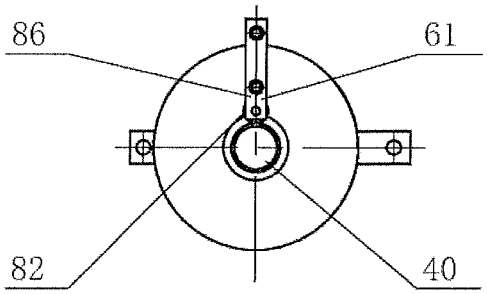
FIG. 12 is a schematic diagram of a rolling head according to an embodiment, wherein the rolling head is arranged on the circumference and rotatably fixed on a rolling wheel seat.
Figure 13:
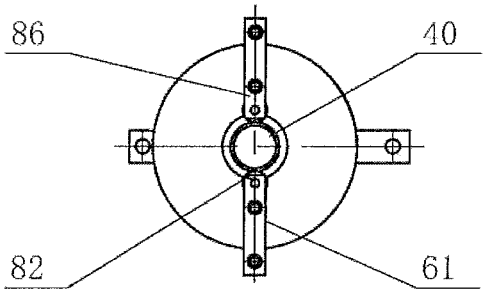
FIG. 13 is a schematic diagram of a rolling head according to an embodiment, wherein the rolling head includes two rolling wheels arranged on the circumference and rotatably fixed on a rolling wheel seat.
Figure 14:
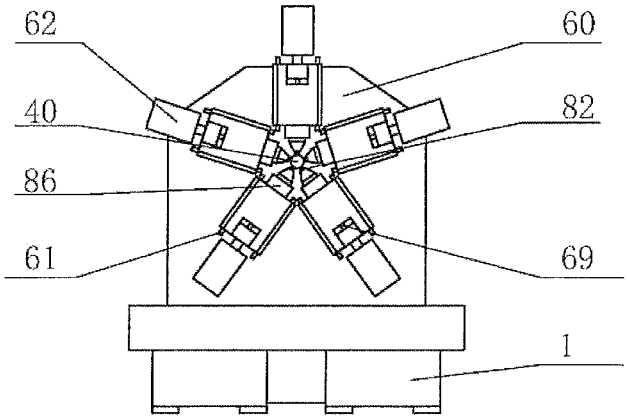
FIG. 14 is a schematic diagram of a rolling head according to an embodiment, wherein the rolling head includes five rolling wheels which are arranged on the circumference and rotatably fixed on a rolling wheel.

FIGS. 12-14 show distribution mode of rolling wheels of three types of rolling heads according to the invention.

FIG. 12 is a schematic diagram of a rolling head provided with one rolling wheel according to an embodiment of the invention. A hollowed cylindrical blank 40 may produce the same technical effect as realized by numerous rolling wheels used for simultaneous rolling of hollowed cylindrical blanks when it is in high-speed rotation relative to the rolling wheel 82. Owing to high-speed rotation of such single rolling wheel, rolling interval at the same point on the circumference of the hollowed cylindrical blank is equivalent to that for rolling of work pieces with several rolling wheels.

FIG. 13 is a schematic diagram of a rolling heads with 2 rolling wheels equally distributed on the circumference according to an embodiment. As shown in the figure, 40, 61, 86 and 82 represent hollowed cylindrical blank, rolling wheel seat chute, rolling wheel seat and rolling wheel, respectively.

Rolling wheel seat 86 as shown in FIGS. 12 and 13 utilizes a transmission mechanism to realize a radial feeding along the rolling wheel seat chute according to process requirements.

FIG. 14 is a schematic diagram of a rolling head with 5 rolling wheels equally distributed on the circumference according to an embodiment.

For numbers in the figure, 1 refers to the base; 40 refer to a hollowed cylindrical blank; 61 refers a rolling wheel seat chute; 62 refers to a servo motor; 69 refers to a ball screw; 82 refers to a rolling wheel. When the hollowed cylindrical blank 40 is in high-speed rotation, the servo motor 62 will rotate to facilitate radial movement of the rolling wheel 82 on the rolling wheel seat 86 via ball screw 69.

Figure 15:
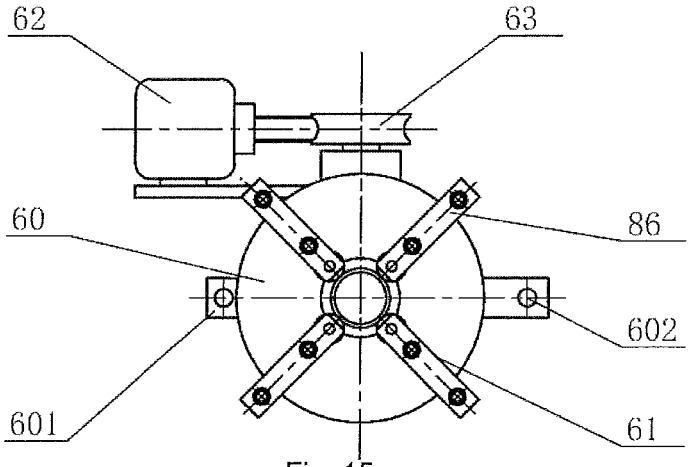
FIG. 15 is a front structural view of a rolling head including four wheels according to an embodiment of the invention.
Figure 16:
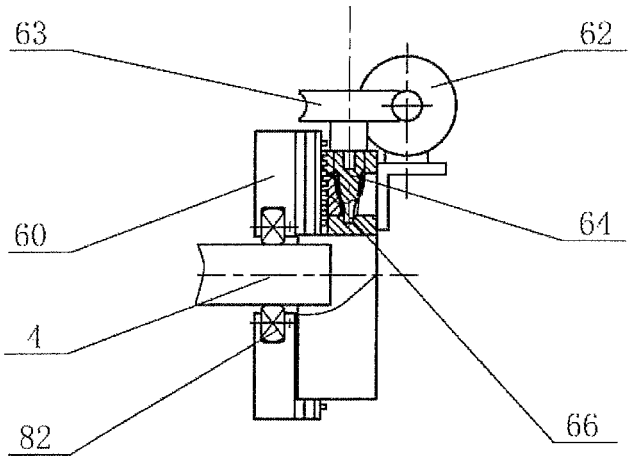
FIG. 16 is a side structural view of FIG. 15.
Figure 17:
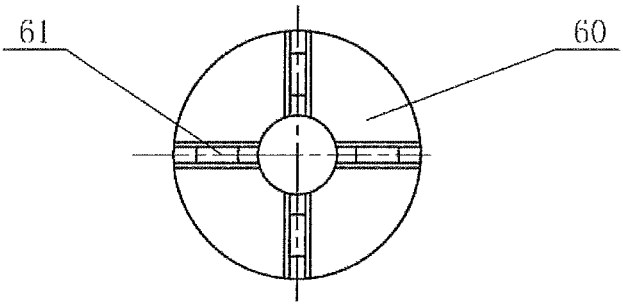
FIG. 17 is a structural sectional view of an external circular shell plate shown in FIG. 16.
Figure 18:
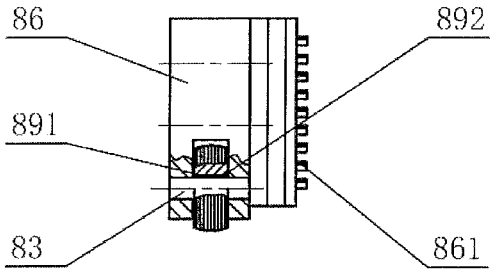
FIG. 18 is a structural sectional view of a rolling wheel seat of a rolling head shown in FIG. 15.
Figure 19:
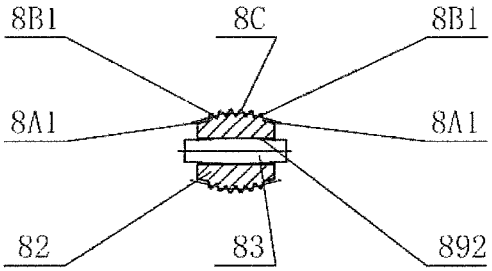
FIG. 19 is a structural sectional view of a rolling wheel structure engaging with a rolling wheel axle shown in FIG. 18.
Figure 20:
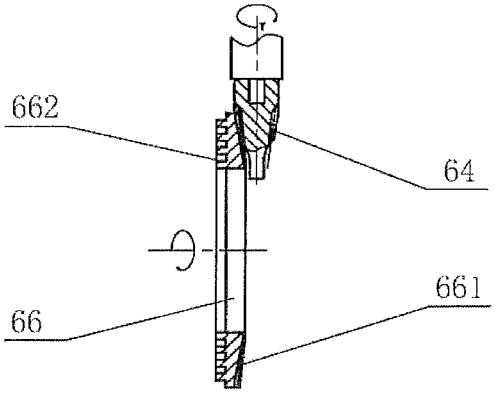
FIG. 20 is a structural sectional view of a rotating disc provided with a spiral groove on one side and a bevel gear on the other side and engaging with a control lever shown in FIG. 16.

FIGS. 15-20 show a pipe thread rolling head with 4 rolling wheels, comprising an external circular shell plate 60, a rotating disc 66, a gear control lever 64, a worm gear 63, a power motor 62, a rolling wheel seat 86 and a rolling wheel 82. FIG. 15 shows the external circular plate 60*m*, two sides at the bottom of which are in gapped floating connection with central round hole on both sides of a slide in the rolling equipment via two cylindrical pins 602 on the two link plates 601; the gapped floating connection aims to make the center of the hollowed cylindrical blank consistent with a central position of the rolling head during specific operation. FIG. 16 shows the external circular shell plate 60 and the rotating disc 66. The rotating disc 66 is arranged on the right side of the external circular shell plate through an axle-hole fitting for concentric installation on the round axle in together with the external circular shell plate 60; rotating disc 66 is provided with a spiral groove 662 on the side opposite to external shell plate 60 (FIG. 20). FIG. 17 shows 4 radial rolling wheel seat chutes 61 provided on the external circular shell plate 60. FIG. 18 shows a radial movement of the rolling wheel seat on the rolling wheel seat chute 61 of the external circular shell plate 60 through mutual coordination between numerous spiral convex grooves 861 on its left side and spiral grooves 662 of the rotating disc 66. As shown in FIG. 20, a bevel gear 661 is formed on the right side of the rotating disc 66, of which central axis is approximately overlapped with that of the rolling head. The bevel gear 661 is engaged with another bevel gear provided on the gear control lever 64. A central axis of the another bevel gear on the gear control lever 64 forms a certain angle with the central axis of the bevel gear 661 along the longitudinal axis of the gear control lever 64. In the specific embodiment, the certain angle is equivalent to 90°. The gear control lever 64 can make the rotating disc 66 rotate around axis thereof. The rotating disc 66 in rotation makes use of the spiral convex groove 861 matching with spiral groove 662 to realize radial movement of the rolling wheel seat 86 along the rolling wheel seat chute 61 on the external circular shell plate 60. As shown in FIG. 18, a front end of the rolling wheel seat 86 is mounted with a non-full-length external pipe thread rolling wheel 82 via a circular pin axle 83; two longitudinal sides of the rolling wheel 82 are provided with a guide part 8A1, a pre-forming part 8B1 and a conical pipe thread forming part 8C; the pipe thread forming part is provided with 2 circles of threads. Nevertheless, other circles are also available without departing from the scope of the invention. Identical forming structure on both sides aims to make the service life of rolling wheel doubled. A central hole of the external pipe thread rolling wheel 82 engages with a circular pin axle 83 and between them maintain a certain axial gap 891 and a radial gap 892, so as to facilitate automatic matching of 4 rolling wheels at the initial stage during rolling and further minimize damages to piping materials by radial force produced during rolling. The power motor 62 makes use of the worm gear 63 to set the gear control lever 64 and the rotating disc 66 into rotation in turn, and control 4 non-full-length external pipe thread rolling wheels 82 on the 4 rolling wheel seats inside the rolling wheel chute 61 on the external circular shell plate 60 based on mutual action of the convex spiral groove 861 on the rolling wheel seat 86 and the spiral groove 661 on the rotating disc 66; this forms a conical external pipe thread rolling head available for axial movement as composed of numerous non-full-length rolling wheels available for radial movement and achieves the purpose for rolling an external pipe thread products with different dimensions. It is to be understood that rotation of the rotating disc can be achieved through other transmission modes besides gear transmission. It is also to be understood that the worm gear 62 can be replaced by any other transmission mechanism known in the art, such as a ball screw and a crank link.

The above rolling head can be provided with other number of rolling wheels, such as 3, 6 or more rolling wheels in addition to 1, 2, 4 and 5 ones as specified in aforesaid embodiments, and preferably, the number of the rolling wheel is 4 or 5.

Figure 21:
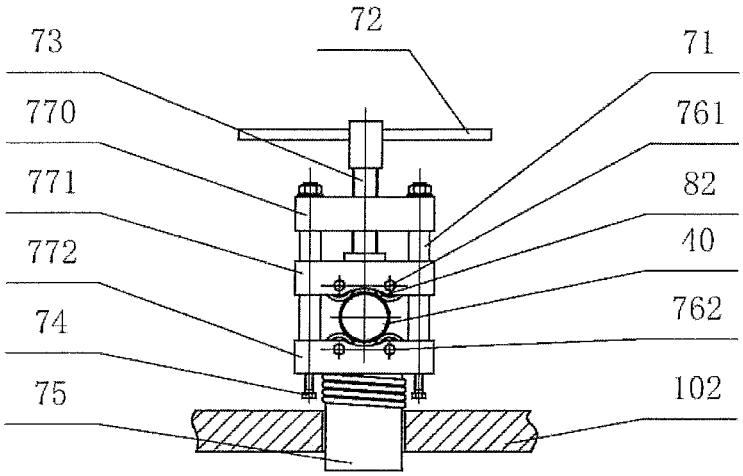
FIG. 21 is a structural schematic diagram of a rolling head including four rolling wheels available for manually regulated radial feeding according to an embodiment of the invention.

FIG. 21 shows another external pipe thread rolling head according to another embodiment. The external pipe thread rolling head comprises a spring contained cylinder 75, two guide pins 71, an intermediate lever 771 and an upper rolling wheel seat 761 installed on the intermediate lever 771, a lower lever 772 and a lower rolling wheel seat 762 installed on the lower lever 772, an upper lever 770, a screw 73, a dynamic rotating handle 72 and four floating adjusting bolts 74 (the last two adjusting bolts not shown). Although the number of the adjusting bolts is 4 in the embodiment, it is to be understood that the number also may be 2 or 3 and so on. Upper and lower ends of the two guide pins 71 are fixed on both sides of upper lever 770 and lower lever 772 on external pipe thread rolling device to form a framework. The two guide pins 71 penetrate through holes provided on both sides of the intermediate lever 771, wherein the intermediate lever 771 can move vertically in the holes. The upper lever 770 is provided with a vertical threaded hole. The screw 73 is engaged with the threaded hole. Upper end of the screw 73 is fixed to the dynamic rotating handle 72 and lower end of it is pressed against the intermediate lever 771, to realize vertical movement of the intermediate lever 771 along the guide pins 71 on both sides and radial movement of the rolling wheel seat 761 on the intermediate lever 771 when screw 73 is rotated by rotating handle 72. Bottom of the cylinder 75 is in gapped floating connection with a central round hole of the slide 102 of the rolling equipment; both ends of spiral spring covered on the cylinder 75 are pressed against the slide 102 of the rolling equipment and the lower lever 772 respectively to realize floating connection of the rolling head. Four floated adjusting bolts 74 (the last two adjusting bolts not shown) are connected with internal thread of the lower lever 772, and projected out of its underside to keep the projected end away from the surface of the slide 102 of the rolling equipment by certain distance; the length projected from the lower lever can be adjusted by the threaded connection, to further adjust interval distance to the slide 102 of the rolling equipment, so as to control a left-right swing amplitude of the rolling head. Two upper and two lower rolling wheels 82 are arranged on the upper and lower rolling wheel seats respectively on the circumference of the hollowed cylindrical blank 40. Preferably number of threads of the rolling wheel is equivalent to 2. Assembly method for the upper and lower rolling wheel seats and rolling wheels 82 are similar to the method in aforesaid embodiment, which is not to be described in details herein. One can adjust rotating handle 72 through rotation to control vertical feeding of the intermediate lever 771 and control radial feeding position of the rolling wheels 82, thereby achieving radial and synchronous feeding of the rolling wheel according to technical requirements for rolling taper and thread in case of axial movement of the rolling device of the invention. It can also realize rolling of external pipe thread products for steel pipes of different dimensions. It should be pointed out that the rotating handle 72 can be rotated manually or by means of direct driving by the motor or any transmission mechanism as known in the art.

Figure 22:
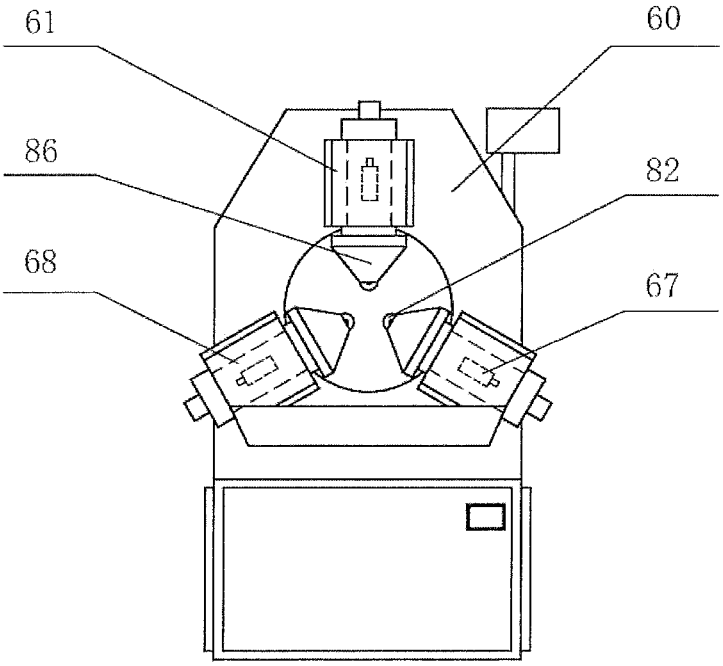
FIG. 22 is a structural schematic diagram of a rolling head including three rolling wheels according to an embodiment of the invention, wherein the radial position of the rolling wheels are regulated by hydraulic proportion regulation or pneumatic proportion regulation.

FIG. 22 shows an external pipe thread rolling head subjected to hydraulic regulation according to an embodiment, comprising a fixed circular disc 60, three hydraulic cylinders 68 installed circumferentially and an oil cylinder proportion servo valve 67. Inner end of the oil cylinder is installed with the rolling wheel seat 86 and the rolling wheel 82 of the invention fixed to the rolling wheel seat. Assembly mode for the rolling wheel seat 86 and the rolling wheel 82 is similar to methods in aforesaid two embodiments, and is not to be described in details herein. One can start a powered cylinder via the proportional servo vale 67 to drive the rolling wheel seat 86, thereby achieving radial synchronous feeding of the rolling wheel according to technical requirements for rolling taper in case of axial movement of the hollowed cylindrical blank of the invention. It can also realize rolling of external pipe thread products for steel pipes with different dimensions. Besides the hydraulic oil cylinder, a control cylinder can also be used to realize synchronous control of radial synchronous feeding of the rolling wheel seat 86 and the rolling wheel 82 connected to a cylinder piston rod, so as to achieve the objectives of the invention.

From FIGS. 4-6 and FIGS. 15-22, the technical features of the rolling process according to the invention are obvious. Although the invention is described herein through the preferred embodiments, they are not used for limitation of the invention. Any skilled person in the art can make various equivalent changes or substitutions based on the concept and scope of the invention; For instance, structure of the rolling head is also available for reasonable arrangement and transformation in reference to corresponding rolling head devices as disclosed in any of the following patents: U.S. Pat. Nos. 5,699,691A, 3,058,196A, EP282889A2, U.S. Pat. Nos. 3,452,567A, 3,058,196A, US20060162411A1, JP10034270A, JP10244340A, JP2003126937A, JP9327742A, CN100542735C, CN2555962Y, CN103264128A, CN103286245A, SU1344479A1, US20120011912A1, U.S. Pat. Nos. 4,617,816A, 4,785,649A, 5,870,918A, GB1150525A, JP1273637A and SU703197A1.

FIGS. 23-36 are schematic diagrams showing the external pipe thread rolling wheel and its various axial and radial gap-fit according to the invention.

Figure 23:
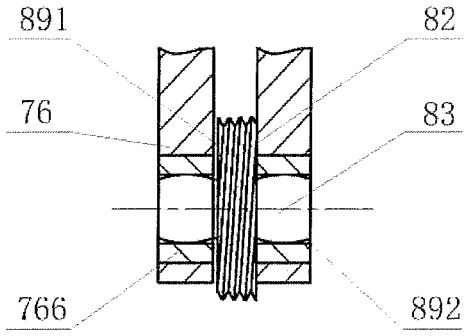
FIGS. 23-25 are schematic diagrams showing that a rolling wheel is formed integrally with a rolling wheel axel according to the invention, wherein a floating connection between the rolling wheel and the rolling wheel seat is achieved through axle-borehole fit and there are an axial movement space and a radial movement space between the rolling wheel and the rolling wheel seat.
Figure 24:
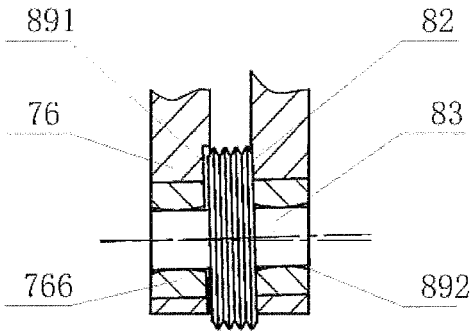
Figure 25:
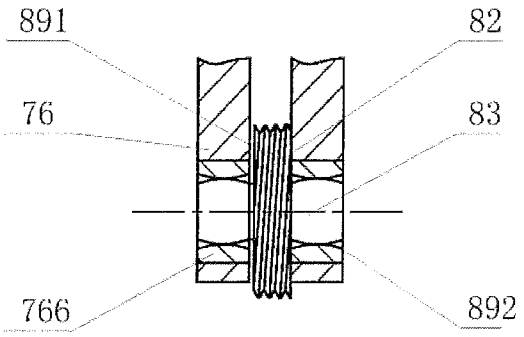

FIGS. 23-25 are schematic diagrams showing that a rolling wheel is formed integrally with a rolling wheel axel according to the invention, wherein a floating connection between the rolling wheel and the rolling wheel axel is achieved through axle-borehole fit and there are an axial movement space and a radial movement space between the rolling wheel and the rolling wheel axle.

As indicated in the aforesaid figures, the rolling wheel 82 is set on an axle sleeve 766 of a rolling wheel seat 76 via rolling wheel axles 83 on both sides. The axle sleeve 766 improves a flexibility of a floating connection between the rolling wheel and the rolling wheel seat. 891 and 892 represent axial and radial gap of various fittings, respectively.

As shown in FIG. 23, both ends of the rolling wheel 82 are provided with projected circular axle pins, which engage with cylindrical holes provided on the rolling wheel seat 76 through axle-hole fitting to achieve floating connection and form an axial and radial movement space, i.e., the axial and radial gap 891 and 892.

As shown in FIG. 24, both ends of the rolling wheel 82 are provided with cylindrical axle pins, which engage with projected cylindrical holes provided on the rolling wheel seat 76 through axle-hole fitting to achieve floating connection and form an axial and radial movement space, i.e., the axial and radial gap 891 and 892.

As shown in FIG. 25, both ends of the rolling wheel 82 are provided with projected cylindrical axle pins, which engage with projected cylindrical holes provided on the rolling wheel seat 76 through axle-hole fitting to achieve floating connection and form an axial and radial movement space, i.e., the axial and radial gap 891 and 892.

What is used in aforesaid structures is an integrated rolling wheel. In other words, the rolling wheels 83 and 82 are an integrated structure; the most remarkable advantage using integrated rolling wheels is that diameter of the rolling wheel is not affected by diameter of an internal bore of the rolling wheel 82 and diameter of its axle 83. Therefore, the diameter of the rolling wheel can be very small, such as 10 mm or even much smaller, which creates technical conditions for supplementation of rolling wheels installed on the rolling head.

Figure 26:
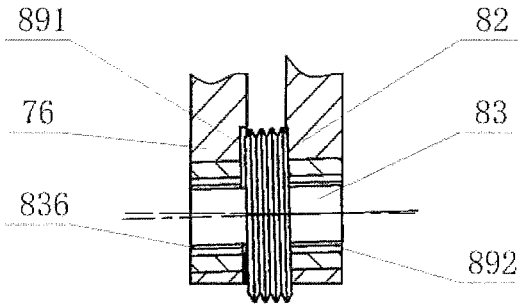
FIG. 26 is a schematic diagram showing that a rolling wheel is formed integrally with a rolling wheel axel according to the invention, wherein a floating connection between the rolling wheel provided with a needle (bearing) and a bearing hole of the rolling wheel seat is achieved through axle-borehole fit and there are an axial movement space and a radial movement space between the rolling wheel and the rolling wheel seat.

FIG. 26 is a schematic diagram of a circular thread rolling wheel integrated with a rolling wheel axel according to the invention, wherein there are a floating connection achieved through axle-borehole fit and an axial movement space and a radial movement space between the rolling wheel and the rolling wheel. As illustrated, the difference between FIG. 26 and FIGS. 23, 24 and 25 is that the needle bearing 836 is used on rolling wheel seat 76 and sliding and rotation effect between the rolling wheel axle 83 and the rolling wheel seat 76 can be further improved through using the needle bearing.

Figure 27:
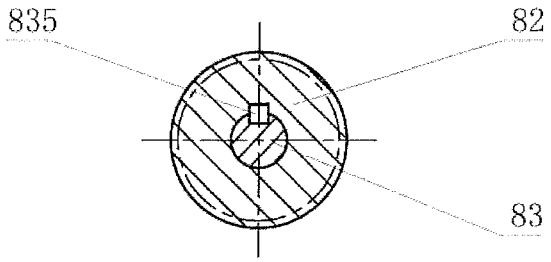
FIG. 27 is a schematic diagram of keyway fitting as a substituting solution of a rolling wheel formed integrally with a rolling wheel axel.

FIG. 27 is a schematic diagram of keyway fitting 835 as a substituting solution of the rolling wheel 82 integrated with the rolling wheel axel 83.

Figure 28:
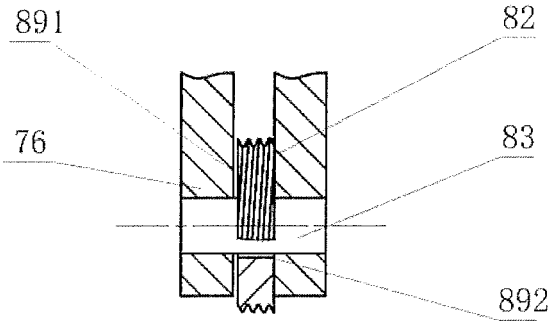
FIG. 28 is a schematic diagram showing no-gap axle-hole fitting other than floating connection between the rolling wheel axle and rolling wheel seat of the invention for realizing free axial and radial movement based on floating connection between the rolling wheel and the rolling wheel axle.

FIG. 28 shows no-gap axle-hole fitting other than floating connection between the rolling wheel axle 83 and the rolling wheel seat 76 of the invention for realizing free axial and radial movement based on floating connection between the rolling wheel 83 and the rolling wheel axle 83.

Figure 29:
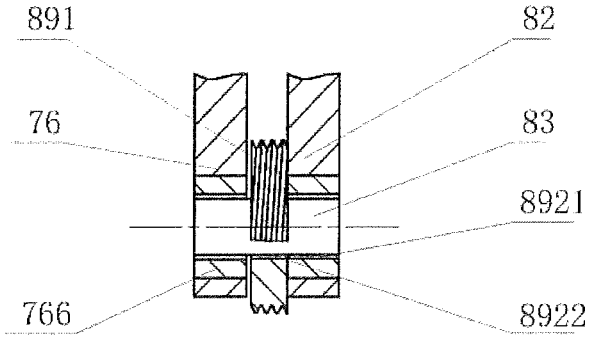
FIG. 29 is a schematic diagram showing gap axle-hole fitting other than floating connection between the rolling wheel axle and the rolling wheel seat of the invention for realizing free axial and radial movement based on floating connection between the rolling wheel and the rolling wheel axle or between the rolling wheel axle and the rolling wheel seat.

FIG. 29 shows gap axle-hole fitting other than floating connection between rolling wheel axle 83 and rolling wheel seat 76 of the invention for realizing free axial and radial movement based on floating connection between the rolling wheel 82 and the rolling wheel axle 83, showing an axial gap 891 and radial gaps 8921 and 8922 in two positions between the rolling wheel 82 and the rolling wheel seat 83 as well as the rolling wheel axle 83 and rolling wheel seat 76.

Figure 30:
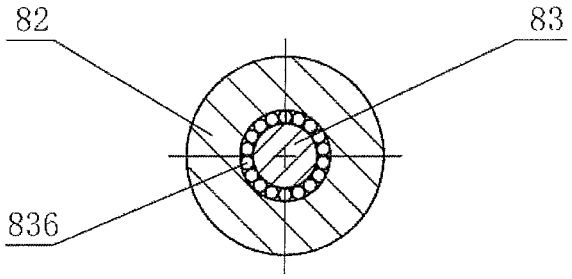
FIGS. 30-31 are schematic diagrams showing free axial and radial movement through floating connection, taking the rolling wheel and rolling wheel axle of the invention as the needle (bearing) and one end of the rolling wheel and the rolling wheel seat as the end bearing.
Figure 31:
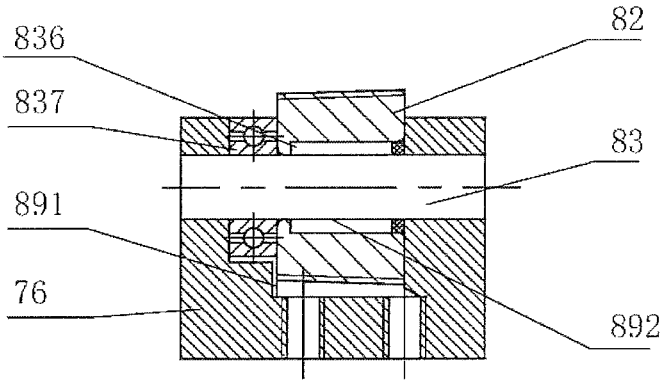

FIGS. 30-31 show the rolling wheel 82 engaging with the rolling wheel seat 83 through floating connection using needle (bearing) according to FIG. 26, and both ends of the rolling wheel are provided with end bearings, so as to realize free axial and radial movement. The needle (bearing) 836 and end bearing 837 can further significantly improve the effect of sliding and rotation between the rolling wheel 82 and the rolling wheel axle 83 as well as the rolling wheel 82 and the rolling wheel seat 76.

Figure 32:
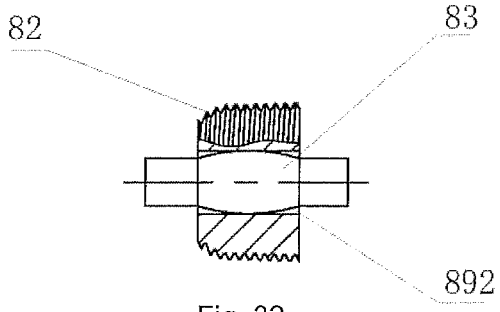
FIGS. 32-34 are schematic diagrams showing free axial and radial movement space achieved by floating connection through three type axle-holes fitting between the rolling wheel and the rolling wheel axle of the invention.
Figure 33:
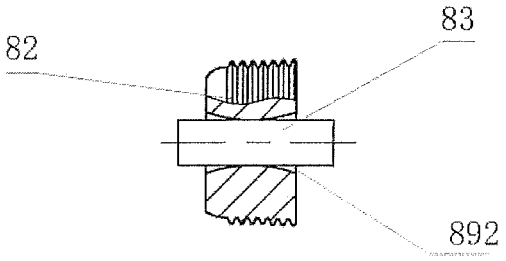
Figure 34:
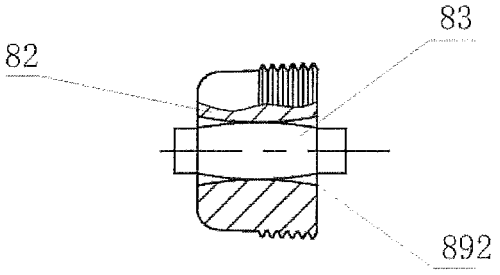

FIGS. 32-34 shows free axial and radial movement space achieved by floating connection through three types of axle-holes fitting between the rolling wheel 82 and the rolling wheel axle 83 of the invention; wherein, only a radial gap 892 is schematic shown.

As shown in FIG. 32, the central part of the rolling wheel axle 83 is in projected circular structure and inner hole of the spiral rolling wheel 82 is in cylindrical structure.

As shown in FIG. 33, the rolling wheel axle 83 is in cylindrical structure; whereas the inner hole of the circular rolling wheel 82 is in projected circular structure.

As shown in FIG. 34, central part of the rolling wheel axle 83 and the inner hole of the circular rolling wheel 82 are in projected circular structure.

Figure 35:
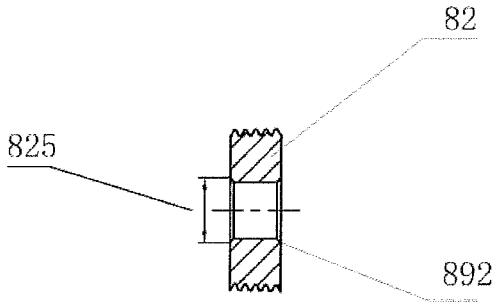
FIGS. 35-36 are schematic structural diagrams showing pipe thread forming part of the rolling wheel of the invention provided with either conical thread or cylindrical thread.
Figure 36:
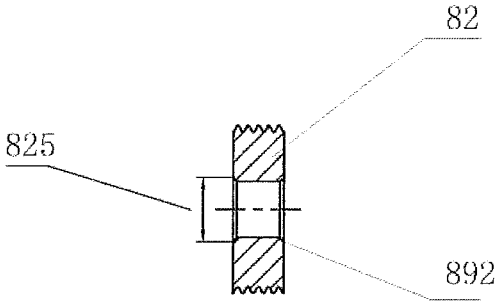

As shown in FIG. 35-36, the pipe thread forming part of the rolling wheel 82 of the invention is provided with a conical thread and a cylindrical thread, respectively, wherein, 825 refers to a diameter of two end holes provided on the rolling wheel, which is equivalent to diameter of the rolling wheel axle plus 0.1 pitch to 1 pitch of corresponding rolling wheel thread so as to form a radial movement space 892.

It should be noted that although an axial gap is not indicated in FIGS. 32-34, and it is essential during actual rolling.

The above rolling wheel can have a spiral thread or circular thread, or is a cylindrical or conical rolling wheel, absolutely depending on rolling process. The purpose of the above axle-hole fitting or bearing fitting or other fittings are used to provide the free axial and radial movement space disclosed in the invention for the rolling wheel moving relative to the rolling wheel seat or the rolling wheel seat relative to the rolling wheel axle, so as to ensure free matching for several rolling wheels at the very beginning of rolling.

FIGS. 37-41 are diagrams showing detailed illustration for various combinations of three parts of the rolling wheel 82 according to the invention, i.e., guide part A, pre-forming part B and pipe thread forming part C.

Figure 37:
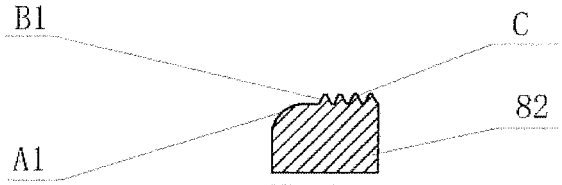
FIGS. 37-41 are schematic diagrams showing detailed illustration for various combinations of three parts according to the invention, i.e., a guide part, a pre-forming part and pipe thread forming part.

FIG. 37 shows an integral structure of a project circular guide part A, a cylindrical pipe thread pre-forming part B1 and a conical pipe thread forming part C of the rolling wheel 82.

Figure 38:
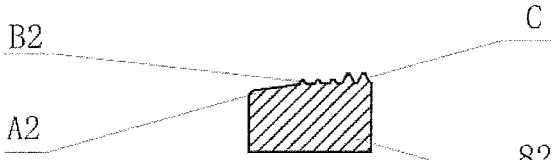

FIG. 38 shows an integral structure of a conical surface guide part A2, an incomplete conical pipe thread pre-forming part B2 and a conical pipe thread forming part C of the rolling wheel 82.

Figure 39:
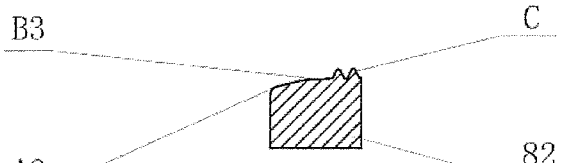

FIG. 39 shows an integral structure of a guide part A3 including a gradually curved surface, a cylindrical pre-forming part B3 and a conical pipe thread forming part C of the rolling wheel 82.

Figure 40:
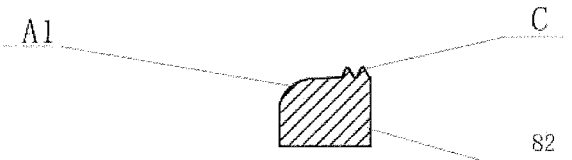

FIG. 40 shows an integral structure of a project circular guide part A1 and a conical pipe thread forming part C of the rolling wheel 82.

Figure 41:
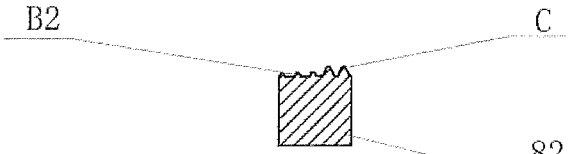

FIG. 41 shows an integral structure of an incomplete cylindrical pipe thread pre-forming part B2 and a conical pipe thread forming part C of the rolling wheel 82.

Figure 42:
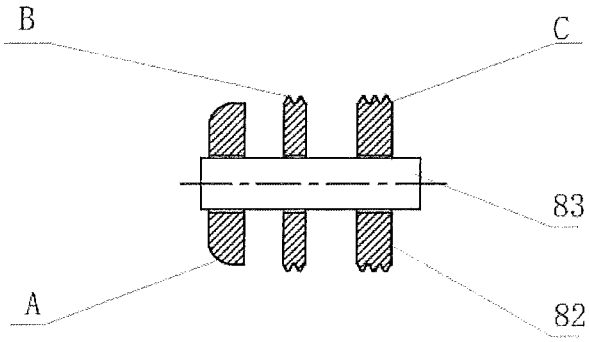
FIG. 42 is a schematic diagram showing a combined structure of three parts of the rolling wheel of the invention, namely a guide part, a pre-forming part and a pipe thread forming part.

FIG. 42 is a schematic diagram showing a combined structure of three parts of the rolling wheel 82 of the invention, i.e., the guide part A, the pre-forming part B and the conical pipe thread forming part C of the rolling wheel 82 are arranged on the rolling wheel axle 83 of the rolling wheel 82 in turn.

The above various combinations of the guide part, the pre-forming part and the thread forming part of the rolling wheels are determined by such conditions as wall thickness, ovality, caliber and material of the hollowed cylindrical blank, materials of the rolling wheel and its estimated service life, design of the rolling head and equipments as well as rolling process requirements.

Figure 43:
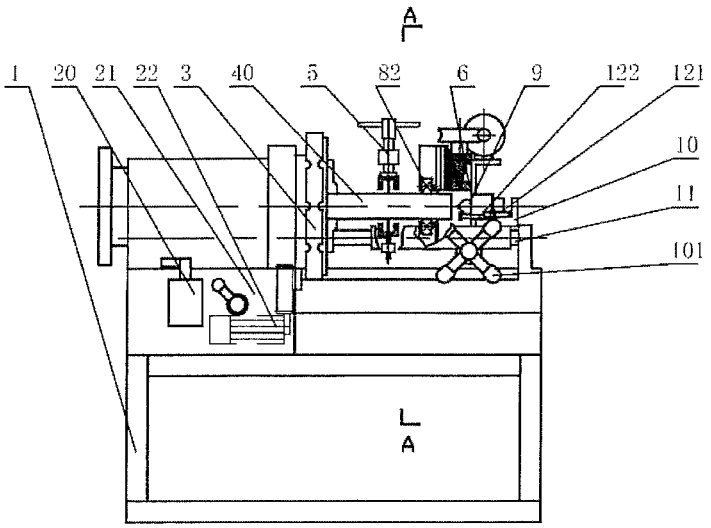
FIG. 43 is a structural front view of the external pipe thread rolling equipment according to an embodiment of the invention.

FIG. 43 is a front structure view of the external pipe thread rolling equipment of the invention.

Figure 44:
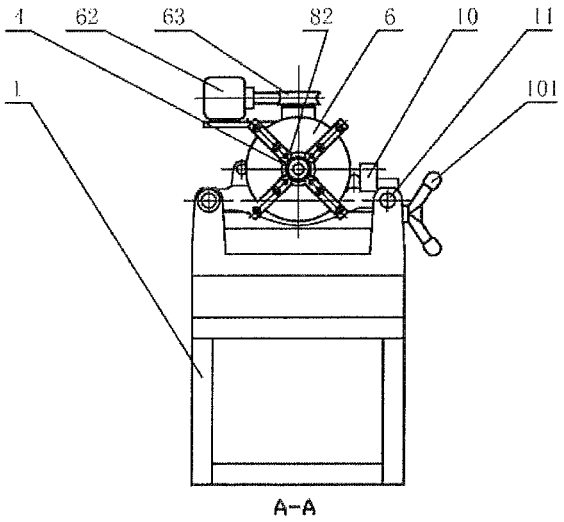
FIG. 44 is a structural side view of FIG. 43.
Figure 45:
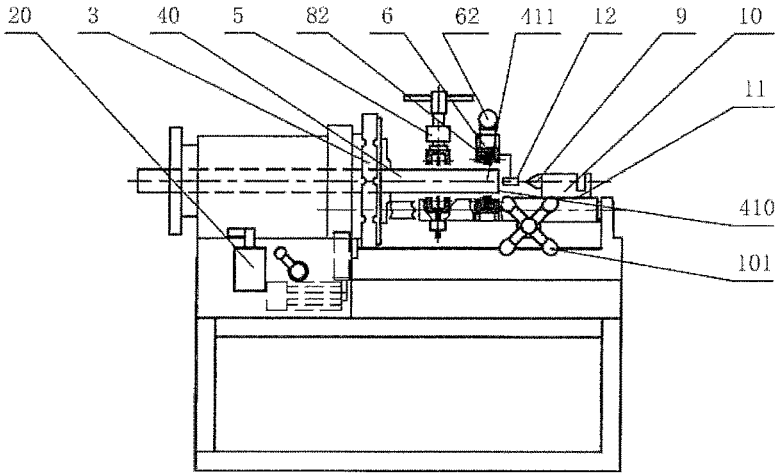
FIG. 45 is a process schematic diagram showing that a conical external pipe thread is processed on the hollowed cylindrical blank through the method for rolling external pipe thread, rolling head and device thereof according to an embodiment of the invention.

FIG. 44 is a structural side view of FIG. 43. The equipment comprises a base 1. One side of upper part of the base is provided with a power motor 22, a transmission device 21, a motor switch 20 and a clamping device 3 used to clamp and rotate the hollowed cylindrical blank 40. On the other side of upper part of the base 1, two axial guide pins 11 provided with a rack are arranged side by side within the horizontal plane parallel to a central line of a main axis; both sides of a bottom of the slide 10 are fixed to the two axial guide pins 11. Inner holes on both sides of the bottom of the slide 10 are provided with a gear for engaging with the rack provided on the axial guide pins 11. It is applicable to rotate rocking handle 101 to facilitate axial movement of slide 10. A floating conical external pipe thread rolling device 6 concentric with the main axis is provided on the slide 10 just opposite to one side of variable speed device 21 as driven by the powered motor. The rolling device 6 is installed with four rolling wheels 82 of the invention arranged on the circumference for radial and synchronous movement, wherein the length of thread is equivalent to 2 circles of thread. The rolling device 6 can drive the slide 10 to move on the axial guide pin 11 under axial force. The servo motor 62 controls a radial taper of the rolling wheel 82 and feeding of thread rolling via a worm gear 63. A photoelectric sensing device is assembled by a photoelectric sensor 121 and a photoelectric sensing rod 122. When the rolling wheel carries out a thread rolling process from the initial end at the hollowed cylindrical blank to the orifice end, the thread head of the product contacts with the photoelectric sensing rod 122 to start the photoelectric sensor 121 and switch off the main motor 22. Meanwhile, the servo motor 62 is in reversed rotation, and the rolling wheel 82 will exit from the rolling position. As shown in FIG. 45, the rolling equipment can be equipped with a cutting device 5 and a chamfering device 9, so that the rolling equipment can process products with any length and have function of chamfering and bur removal according to technical requirements.

FIG. 45 is a structural diagram of the equipment according to an embodiment, showing that a conical external pipe thread is processed on the hollowed cylindrical through the method for rolling external pipe threads, rolling head and device thereof of the invention.

Figure 46:
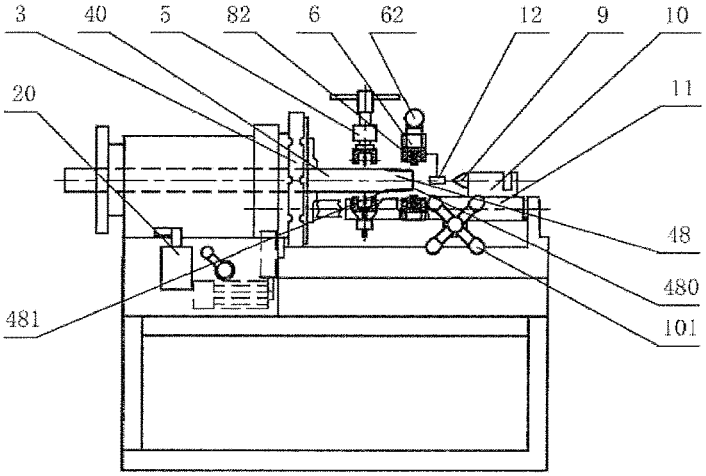
FIG. 46 is a process schematic diagram after completing rolling process as shown in FIG. 45.

FIG. 46 is a schematic diagram showing that the rolling process of the invention is completed.

Figure 47:
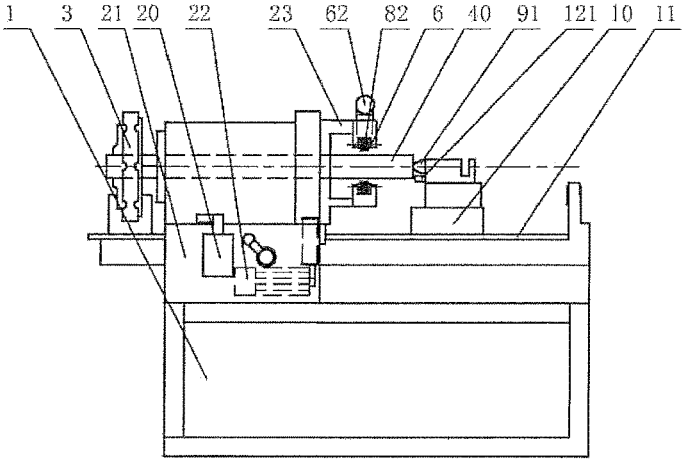
FIG. 47 is a schematic structural diagram showing the other rolling equipment comprising the rolling head of the invention for rotation.

FIG. 45 shows conditions of the equipment, covering material cutting and rolling preparations. FIG. 46 shows withdrawal of rolling wheel 82 under the action of photoelectric sensing device 12 upon completing rolling as well as processing of external pipe thread products and chamfering preparations FIG. 47 is a structural diagram of the equipment comprising the rotating rolling head of the invention. The equipment comprises a base 1. A power motor 22, a transmission device 21 and a motor switch 20 are provided on the left side of upper part of the base 1. The transmission device 21 is connected to a hollowed shaft 23 to facilitate transition from rotation of power motor 22 at high speed and less torque to rotation of hollowed shaft at lower speed and higher torque; the hollowed shaft 23 is connected to the rolling head 6. In this way, the power motor 22 in rotation can make rolling head 6 rotate via the hollowed shaft; one rolling end is fixed by the clamping device 3, and the other end is provided with external pipe thread of hollowed cylindrical blank 40 subjecting to central hole positioning via central hole positioning ejection pin 91; a double-plane guide rail 11 within the same horizontal plane is provided on the upper part of the base 1 parallel to a central line of a main axis; one side of the slide 10 is provided with a clamping device 3, Whereas the other side is provided with a central hole positioning device for the hollowed cylindrical blank 91 of the same plane and co-axiality. Pipe thread rolling device 6 is installed with four rolling wheels 82 arranged on the circumference for radial and synchronous movement. Working principles for rolling conical external pipe thread are the same as that shown in FIGS. 43-44. Once rolling of hollowed cylindrical blanks is completed, a thread head of the product contacts with the photoelectric sensing device 121 to switch off main motor 22. Meanwhile, the servo motor 62 rotates reversely, and the rolling wheel 82 will exit from the rolling position. As shown in FIG. 45, the rolling equipment can be equipped with a cutting device 5 according to technical requirements. When a chamfering device 9 is used to replace the positioning device 91 for the central hole of the hollowed cylindrical blank, the rolling equipment can process products with any length and have function of chamfering and bur removal.

The rolling head of the invention is applicable to aforesaid rolling equipments, which can also be applied to any or combined rolling equipments involved in the following patents after it is modified by the person skilled in the art according to the concept of the invention: U.S. Pat. No. 4,771,625A, JP1273637A, CN102198590A, CN202316603U, CN103264128A and CN1251821C.

Figure 48:
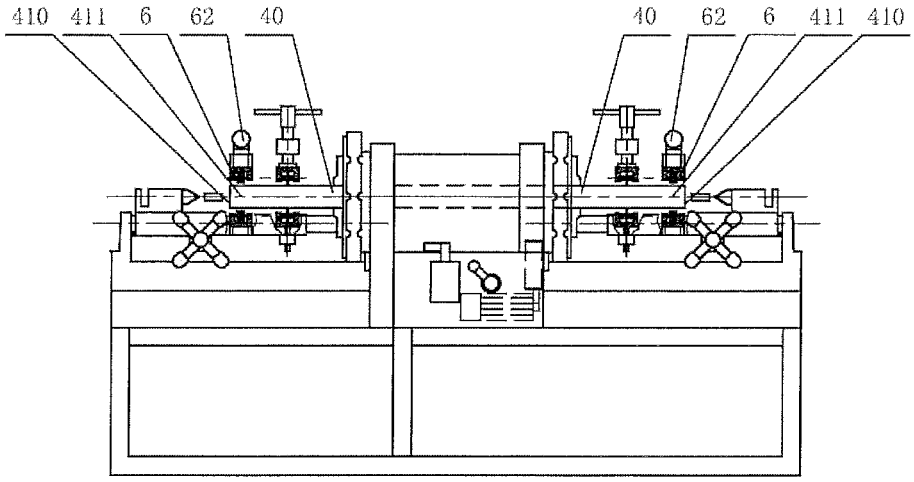
FIG. 48 is a schematic structural diagram of double-head conical external pipe thread production equipment based on the rolling method for rolling an external pipe thread according to an embodiment of the invention.

FIG. 48 is a structural diagram of double-head conical external pipe thread production equipment as manufactured according to the method of the invention. As shown in the figure, rolling heads 6 with varied rotation directions are arranged on left and right sides respectively. When the hollowed cylindrical blank 40 rotates at the specified revolution, the rolling heads 6 on left and right sides will carry out a thread rolling process from the position 411, namely a thread tail of the thread to be processed outwards to the position 410, namely the head of thread to be processed. Meanwhile, a motor for radial feeding device of rolling head 6 is to be used to complete rolling of the double-head conical external pipe thread products. The axial and radial working mode of the left and right rolling heads, basic configuration of the equipment and functions are the same as those mentioned above, and are not to be described herein in details.

EXAMPLES

Taking site installation of DN 32 special galvanized and welded gas pipe with length and wall thickness up to 6000 mm and 3.5 mm, respectively, for instance, the aforesaid purposes, technical solutions and beneficial effect of the invention are described as follows in combination with FIG. 1-6, FIG. 15-20 and FIG. 45-46 based on a comparison with existing external pipe thread rolling techniques.

According to Welded Steel Pipes for Low Pressure Liquid Delivery (GB/T 3091-2008), outer diameter 423, normal wall thickness and inner diameter 422 of DN 32 special galvanized and welded gas pipe are 42.4 mm, 3.5 mm and 35.4 mm, respectively. As shown in FIG. 1, large-tonnage axial punching device is firstly used to process 1:16 conical surface 425 according to existing external pipe thread rolling techniques; as shown in FIGS. 2 and 3, rolling wheel 80 with effective thread length is further rolled in from the orifice end 420, namely front end 460 of the external pipe thread to be process to position 421, namely rear end 461 of the external pipe thread to be processed for axial rolling of external pipe thread products to complete rolling of external pipe thread products 46. However, this brings the following problems:

1. Reduction in inner diameter of the steel pipe is 3.11 mm. In other words, inner diameter of external pipe thread products rolled might be affected by 1.6 mm reduction in inner diameter incurred by punching of conical surface and 1.5 mm further reduction in inner diameter incurred by rolling; inner diameter of the minimum end is only 32.29 mm. Whereas inner hole reduction percentage is 9%, which far exceeds 3.4% as specified by aforesaid national and international standards. This may affect stability of pipe conveyed fluid.

2. It is unlikely to provide each pipe network installation site with large-tonnage special axial punching or extrusion equipments as required by processing of conical surface;

3. Rolling or extrusion pressure on the formed conical surface may incur potential and apparent damages to piping materials, especially weld on the welded pipes at the junction between original outer diameter of steel pipe and conical surface; this may bring forth safety hazards to rolling of external pipe thread products.

To solve aforesaid problems, rolling wheel 82 of the invention with 2 circles of threads as shown in FIGS. 4-6 and FIGS. 15-20 is used. Its thread length is lower than 20% length of 11 circles of effective thread of its products. In other words, length of the rolling wheel of the invention is less than 20% length of rolling wheels using existing rolling techniques. Rolling head is used for rolling from position 411, namely rear end 481 of the external pipe thread to be processed; in case of axial rolling and movement towards position 410 (namely front end 480 of the external pipe thread to be processed) with the help of axial force produced by difference to the spiral angle between rolling wheel on the rolling head and hollowed cylindrical blank during rolling, servo motor 62 and worm gear transmission device 63 as shown in FIGS. 15 and 16 are used to change rotation of motor 62 into radial and synchronous feeding of rolling wheel 82 as per technical requirements for rolling taper. The pipe thread rolling and formation of conical surface are proceeded simultaneously while the external pipe thread on the outer diameter of standard DN 32 steel pipe are rolled directly. Direct rolling method that requires no punching techniques and equipments can prevent any potential and apparent damages incurred by punching pressure and formation of conical surface to piping materials, especially on the welded pipe at the junction 481 between standard outer diameter of steel pipe and conical surface, and thereby significantly minimize safety hazards incurred by existing rolling techniques to external pipe thread products. Meanwhile, it can also control reduction in inner hole 482 of steel pipe at 50% of that specified by prior arts, and improve stability of fluid conveyed inside the pipe.

Specific processing procedures are further described as follows in combination with FIGS. 45 and 46. Firstly, put DN 32 of blank 40 with the same outer diameter as foresaid standard steel pipe into the clamping device 3 for clamping; turn on motor switch 20 to make hollowed cylindrical blank 40 rotate; proceed with radial feeding of floating rolling and cutting device 5 manually to cut hollowed cylindrical blank through rolling until its length is reduced from 6,000 mm to 2,750 mm; further carry out reversed rotation manually to release rolling and cutting device 5; turn off motor switch 20 to complete cutting. Make use of rocking handle 101 to manually initiate axial feeding of external pipe thread rolling device 6 to processing position 411, namely rear end of external pipe thread to be processed; manually realize radial contact between rolling wheel 82 of rolling device 6 with processing position 411 of hollowed cylindrical blank 40; the contacted position 411 will be the rear end 481 of the external pipe thread upon completion of external pipe thread processing; turn on motor switch 20 to make hollowed cylindrical blank 40 rotate; proceed with further radial feeding of rolling wheel 82 to make it roll into position 411; make use of difference between spiral angle of rolling wheel and input angle of hollowed cylindrical blank 40 to facilitate automatic axial movement of slide 10 from position 411 to 410, namely front end 480 of the external pipe thread to be processed along two guide pins 11. Meanwhile, servo motor 62 is to proceed with automatic radial feeding according to preset procedures and technical requirements for rolling taper; when rolling wheel 82 of rolling device 6 on slide 10 axially moves to the front end 480 of the external pipe thread, photoelectric sensing device 12 will start to work to switch off the main powered motor. At the same time, servo motor 62 is started for reversed rotation to withdraw rolling wheel 82 from external pipe thread product 48 to complete rolling. It is applicable to use floating chamfering device 9 according to rolling techniques during external pipe thread processing.

As compared in FIGS. 1-6 and FIGS. 45-46, the differences between conical external pipe thread rolling method, rolling head and device thereof of the invention and those of prior arts are extremely obvious. The beneficial effects as brought forth thereafter are stated as follows:

1. As compared with existing external pipe thread rolling techniques, axial punching or radial extrusion technique is omitted. It is similar to existing cutting and threading procedures as adopted on site. Processing device is easy and convenient for operation, which is available for extensive promotion and application.

2. It makes use of rolling wheel with a thread length of pipe thread forming part lower than effective length to complete one-time positioning and processing of conical surface and external pipe thread through rotation and gradual rolling. This can prevent any potential and apparent damages to steel pipes, especially weld seam on the welded pipes, and improve compactness, connection strength and sealing performance of thread as well as concentricity of external pipe thread products.

3. Reduction in inner hole on external pipe product is in compliance with relevant international and national standards in force.

4. Reduce cost of rolling wheel materials and manufacturing cost.

5. As compared with existing external pipe thread processing techniques through cutting and threading, weight per unit length of the external pipe thread products as formed through rolling is the same as that of original steel pipe. Furthermore, owing to the action of cold hardening during rolling, its bearing capacity has been increased by 100% approximately as compared with corresponding standard external pipe thread products as formed through cutting. Obviously, it is possible to reduce outer diameter or wall thickness of steel pipe while ensuring safety for connection of external pipe thread so as to minimize the consumption of steel pipes, and accomplish objectives for energy saving, emission reduction and environmental protection.

Despite of the fact the invention has been disclosed as above in form of preferred embodiments, it has no restriction on the invention; any common technician who is familiar with this field can make various equivalent changes or modification based on the concept and scope of the invention regardless of such restrictions on rolling method and orientation, length, quantity and installation mode of rolling wheels, quantity and installation mode of rolling heads as well as radial and radial movement modes of rolling wheel seats. For instance, rolling wheels carries out a thread rolling process from rear end of external pipe thread or effective thread or complete thread or other non-thread orifices of complete thread to the front end of thread to complete thread rolling. With regard to thick-wall external pipe thread, rolling wheels carries out a thread rolling process from the front end of external pipe thread, which is to be gradually rolled outwards to the rear end of conical external pipe thread according to technical requirements for rolling taper. Rolling heads are available for rotation in corresponding to the device used for fixing of hollowed cylindrical steel pipe blank or rotation of device used for fixing of blank of hollowed cylindrical piping materials corresponded to the rolling head device or the both. Each rolling wheel is also available for automatic rotation as centered on the rolling wheel axle based on its own rotation power to achieve movement corresponding to the hollowed cylindrical blank. Several rolling wheel seats are available for synchronous radial movement or asynchronous movement. For different types of steel pipes such as carbon steel pipes, stainless steel pipes, copper pipes, titanium alloy pipes and special alloy steel pipes equal to or over 24 inches, steel pipes of different dimension, such as 1/16 inch or other steel pipes of non-standard outer diameter, steel pipes of different wall thickness, seamed and seamless steel pipes as well as different external pipe thread profiles, such as NPT, BSPT, API and metric pipe thread, it is applicable to adjust the number of threads on aforesaid rolling wheels according to appropriate rolling pressure principle of the invention and to determine the length of rolling wheels through adjustment of axial and radial feeding proportion of rolling head device and processing of external pipe thread with the rolling method as disclosed in the invention to accommodate with various standard and non-standard piping materials. Rolling method of the invention is applicable to both hollowed and solid cylindrical blanks. Therefore, protection scope of the invention is to be consistent with that as defined by claims attached.

A LIST OF DRAWING MARKINGS

1 Base and base frame
2 Power motor and transmission device
20 Motor switch
21 Transmission device
22 Power motor
23 Hollowed shaft
3 Clamping device for work piece
4 Hollowed cylindrical blank and pipe thread product
40 Hollowed cylindrical blank

41 Hollowed cylindrical blank using existing cutting technologies
410 Initial end for processing
411 Final end for processing
42 Hollowed cylindrical blanks using existing rolling techniques
420 Initial end for processing
421 Final end for processing
422 Cylinder inner diameter
423 Cylinder outer diameter
425 Cylindrical cone
46 Pipe thread products using existing rolling techniques
460 thread head
461 thread tail
462 Inner diameter of product
465 Conical surface of product
48 Pipe thread product of the invention
480 thread head
481 thread tail
482 Inner diameter of product
5 Rolling & cutting device
6 (Circular) rolling head
60 Rolling head body (fixing plate)
601 Axle hole of fixed disc
602 Shaft of fixed disc
61 Rolling wheel seat chute
62 Powered motor inside the rolling head
63 Worm gear
64 Gear control lever
66 Rotating disc
661 Bevel gear
662 Spiral groove
67 Proportional servo valve for hydraulic cylinder or cylinder
68 Hydraulic cylinder or cylinder
69 Ball screw
7 (Square) rolling head
70 Rolling head body
71 Guide pin
72 Powered rotating handle
73 Screw
74 Floating adjusting bolt
75 Floating spring rod
76 Rolling wheel seat
761 Upper rolling wheel seat
762 Lower rolling wheel seat
766 Bearing
77 Cross lever
770 Upper lever
771 Intermediate lever
772 Lower lever
8 Rolling wheel
80 Rolling wheel of prior arts
82 Rolling wheel of the invention
825 Rolling wheel orifice diameter
83 Rolling wheel axle of the invention
835 Flat key
836 Needle bearing for rolling wheel axle of the invention
837 End bearing
86 Rolling wheel seat
861 Spiral convex groove
89 Gap
891 Axial gap
892 Radial gap
8A guide part (rolling wheel body)
A1 Projected circular guide part
A2 Conical surface or conical surface guide part
A3 Gradually curved guide part
8B Pre-forming part (rolling wheel)
B1 Pre-forming part of cylindrical pipe thread
B2 Pre-forming part of incomplete pipe thread
B3 Pre-forming part of cylindrical surface
8C Pre-forming part of conical pipe thread (rolling wheel)
9 Chamfering device
91 Central hole positioning ejection device
10 Side
101 Slide rocking handle
11 Axial guide pins (2) or plane guide rail on the base
12 Photoelectric sensing device
121 Photoelectric sensor
122 Photoelectric sensing feeler lever
a Real-time taper
a1 ½ real-time taper 1
a2 ½ real-time taper 2
dF External force imposed
dF1 Radial force on thread profile rolled
dF2 Radial force on taper rolled
dTf Tangent force during rolling
dT Torque produced by rotation
dTt Tangent force during rolling
dZ Axial force produced by difference to spiral angle between rolling wheel and cylindrical blank
dR Rolling pressure produced
dX Force on Axis X
dY Force on Axis Y

The invention claimed is:

1. A method for rolling an external pipe thread, comprising carrying out a thread rolling with more than two rolling wheels, wherein the thread rolling starts from a thread tail of the external pipe thread and moves towards a thread head of the external pipe thread, thereby completing the thread rolling;

the external pipe thread is a conical pipe thread;

the plurality of rolling wheels regulate their radial position in real-time during a whole process of dynamic rolling through a radial position regulating device so as to form a taper as required by a rolling process; and no support is required inside the pipe during rolling.

2. The method for rolling an external pipe thread according to claim 1, wherein the rolling wheel is provided with a pipe thread forming part which has a thread length less than an effective thread length of the external pipe thread to be rolled.

3. The method for rolling an external pipe thread according to claim 2, wherein the thread length of the pipe thread forming part is equivalent to a length of one, two, three, four or five circles of the external pipe thread.

4. The method for rolling an external pipe thread according to claim 2, wherein the more than two rolling wheels is 4 or 5 rolling wheels.

5. The method for rolling an external pipe thread according to claim 1, wherein an axial rolling force as produced by the rolling wheel during the thread rolling is used to shift the rolling wheel from the thread tail towards the thread head relative to a hollowed cylindrical blank, while the radial position regulating device is used to control a radial feeding of the rolling wheel according to variation of axial position of the rolling wheel so that the conical external pipe thread is formed by rolling directly.

6. The method for rolling an external pipe thread according to claim 5, wherein a ratio between radial feeding velocity of the rolling wheel and axial shifting velocity of the rolling wheel relative to the hollowed cylindrical blank is equivalent to ½ of a real-time taper of the external pipe thread.

* * * * *